US009653808B2

(12) United States Patent
Hwang et al.

(10) Patent No.: US 9,653,808 B2
(45) Date of Patent: May 16, 2017

(54) MULTILAYER PATCH ANTENNA

(71) Applicant: AMOTECH CO., LTD., Incheon (KR)

(72) Inventors: Chul Hwang, Incheon (KR); In-Jo Jeong, Incheon (KR); Sang-O Kim, Incheon (KR); Ki-Hwan You, Incheon (KR); Tae-Jae Cho, Incheon (KR); Gil-Yup Song, Incheon (KR); Kyou-Yub Lee, Seoul (KR); Hyeong-Jin Yoon, Incheon (KR)

(73) Assignee: AMOTECH CO., LTD., Incheon (KR)

( * ) Notice: Subject to any disclaimer, the term of this patent is extended or adjusted under 35 U.S.C. 154(b) by 389 days.

(21) Appl. No.: 14/328,141

(22) Filed: Jul. 10, 2014

(65) Prior Publication Data

US 2016/0013558 A1 Jan. 14, 2016

(51) Int. Cl.
*H01Q 9/04* (2006.01)

(52) U.S. Cl.
CPC ..... *H01Q 9/0414* (2013.01); *H01Q 9/0435* (2013.01); *H01Q 9/0457* (2013.01)

(58) Field of Classification Search
CPC .... H01Q 9/0414; H01Q 9/045; H01Q 9/0435; H01Q 9/0407
USPC ..... 343/906
See application file for complete search history.

(56) References Cited

U.S. PATENT DOCUMENTS 6,225,959 B1 * 5/2001 Gordon ..... H01Q 13/103 343/700 MS
8,102,330 B1 * 1/2012 Albers ..... H01Q 5/40 333/117
2009/0140927 A1 * 6/2009 Maeda ..... H01Q 9/0407 343/700 MS

FOREIGN PATENT DOCUMENTS

KR 1020100110052 10/2010
KR 1020110066639 6/2011

* cited by examiner

*Primary Examiner* — Dameon E Levi
*Assistant Examiner* — Andrea Lindgren Baltzell
(74) *Attorney, Agent, or Firm* — Hamre, Schumann, Mueller & Larson, P.C.

(57) ABSTRACT

Disclosed is a multilayer-type patch antenna including: an upper patch antenna portion having a first through hole and a second through hole which are at a predetermined angle; a lower patch antenna portion having a third through hole and a fourth through hole which are at a predetermined angle, and a fifth through hole which is spaced from the third through hole and the fourth through hole; a first feeding pin which passes through the first through hole and the third through hole and protrudes from a lower end of the lower patch antenna portion; a second feeding pin which passes through the second through hole and the fourth through hole and protrudes from the lower end of the lower patch antenna portion; and a third feeding pin which passes through the fifth through hole and protrudes from the lower end of the lower patch antenna portion.

19 Claims, 30 Drawing Sheets

| Freq. [MHz] | Eff.[%] | Avg. [dBic] | Peak [dBic] | Zenith [dBic] | AR |
|---|---|---|---|---|---|
| 1575.0 | 49.64 | -3.04 | 3.23 | 3.06 | 1.24 |
| 1592.0 | 61.73 | -2.09 | 3.98 | 3.81 | 2.17 |
| 1608.0 | 48.47 | -3.15 | 3.04 | 2.85 | 2.53 |

FIG. 23

| Freq. [MHz] | Eff.[%] | Avg. [dBic] | Peak [dBic] | Zenith [dBic] | AR |
|---|---|---|---|---|---|
| 2320.0 | 80.23 | -0.96 | 5.04 | 4.83 | 2.3 |
| 2332.0 | 85.39 | -0.69 | 5.40 | 5.26 | 1.6 |
| 2345.0 | 81.20 | -0.90 | 5.40 | 5.13 | 2.2 |

FIG. 30

MULTILAYER PATCH ANTENNA

BACKGROUND OF THE INVENTION

1. Technical Field

The present invention relates generally to a patch antenna for a shark fin antenna for a vehicle and, more particularly, to a multilayer-type patch antenna which is built in a shark fin antenna for a vehicle and receives signals within GPS, GLONASS, and SDARS frequency bands.

2. Description of the Related Art

As well known to those skilled in the art, a shark fin antenna for a vehicle is used to improve signal reception rates of electronic devices installed within a vehicle. A shark fin antenna is usually installed outside a vehicle. For example, Korean Patent Application Publication No. 10-2011-0066639 (titled "Antenna Device for Vehicle") and Korean Patent Application Publication No. 10-2010-0110052 (titled "Antenna Device for Vehicle") disclose various types of shark fin antennas for a vehicle.

As recent vehicles are equipped with electronic devices such as a navigation system, a DMB system, and an audio component, a plurality of antennas are built in a shark fin antenna to receive signals within multiple frequency bands, including frequency bands for GPS (U.S.A), GLONASS (Russia), SDARS (operated by Sirius XM), Telematics, FM, and T-DMB.

However, there is a problem that it is difficult to mount all the necessary antennas, for example, antennas for GPS, GLONASS, SDARS, Telematics, FM, and T-DMB within a limited area of a shark fin antenna.

There is another problem that since GPS and GLONASS are selectively used depending on country, a shark fin antenna for vehicle needs to be selectively equipped with either an antenna for GPS or an antenna for GLONASS When each shark fin antenna is not equipped with both GPS and GLONASS antennas but equipped with only a GPS or a GLONASS antenna, shark fin antennas have to be produced on different production lines. This leads to an increase in the production cost of such shark fin antennas. For this reason, many manufacturers are trying to develop shark fin antennas equipped with antennas for both GPS and GLONASS signals.

Conventional patch antennas for GPS are designed to receive signals within a frequency band of about 1576 MHz so that these patch antennas cannot receive a GLONASS signal which has a frequency of about 1602 MHz.

Accordingly, in order for shark fin antennas to pick up both of the GPS and GLONASS signals, each shark fin antenna has to be equipped with antennas for both GPS and GLONASS signals.

However, since recent shark fin antennas are necessarily equipped with antennas for SDARS, Telematics, FM, T-DMB, etc., there is difficulty in designing a shark fin antenna that can accommodate both GPS and GLONASS antennas because of its limited area. Furthermore, the structure of conventional shark fin antennas that has both GPS and GLONASS antennas has the disadvantage of increasing the production cost of shark fin antennas.

SUMMARY OF THE INVENTION

Accordingly, the present invention has been made keeping in mind the above problems occurring in the prior art, and an object of the present invention is to provide a multilayer-type patch antenna that can receive both GPS and GLONASS signals while having advantages of a compact size and a low production cost by employing a structure in which a patch antenna for receiving a GPS signal and an GLONASS signal and a patch antenna for receiving an SDARS signal are layered.

In order to accomplish the above object, the present invention provides a multilayer-type patch antenna including: an upper patch antenna portion having a first through hole and a second through hole which are spaced from each other and arranged such that an angle between the first through hole and the second through hole in reference to a center point of the upper patch antenna portion is a predetermined angle; a lower patch antenna portion having a third through hole and a fourth through hole which are spaced from each other and arranged such that an angle between the third through hole and the fourth through hole in reference to a center point of the lower patch antenna portion is the predetermined angle, and having a fifth through hole which is spaced from the third through hole and the fourth through hole; a first feeding pin, a portion of which passes through the first through hole and the third through hole and protrudes from a lower end of the lower patch antenna portion; a second feeding pin, a portion of which passes through the second through hole and the fourth through hole and protrudes from the lower end of the lower patch antenna portion; and a third feeding pin, a portion of which passes through the fifth through hole and protrudes from the lower end of the lower patch antenna portion.

In the multilayer-type patch antenna, an imaginary line that connects the first through hole and a center point of the upper patch antenna portion has a predetermined angle in reference to an imaginary line that connects the second through hole and the center point of the upper patch antenna portion.

In the multilayer-type patch antenna, an imaginary line that connects the third through hole and a center point of the lower patch antenna portion has a predetermined angle in reference to an imaginary line that connects the fourth through hole and the center point of the lower patch antenna portion.

The predetermined angle may be ranged from 70° to 110°.

The upper patch antenna portion may include: a first radiation patch having a first I-through hole and a second I-through hole arranged such that an angle between the first I-through hole and the second I-through hole in reference to a center point of the first radiation patch is the predetermined angle; and a first base layer which is a dielectric substrate or a magnetic substrate, has a first II-through hole and a second II-through hole in positions corresponding to the first I-through hole and the second I-through hole, respectively, and is stacked on a lower surface of the first radiation patch.

In the multilayer-type patch antenna, an imaginary line that connects the first I-through hole and the center point of the first radiation patch may have the predetermined angle in reference to an imaginary line that connects the second I-through hole and the center point of the first radiation patch.

The multilayer-type patch antenna may further include a first lower patch having a first III-through in a position corresponding to the first I-through hole and the first II-through hole and a second III-through hole in a position corresponding to the second I-through hole and the second II-through hole, the first lower patch being stacked on a lower surface of the first base layer.

The upper patch antenna portion may include a first radiation patch, a first feeding patch having a first I-through hole and being spaced from the first radiation patch, a second feeding patch having a second I-through hole and being spaced from the first radiation patch; and a first base layer which is a dielectric substrate or a magnetic substrate, and which has a first II-through hole and a second II-through hole in positions corresponding to the first I-through hole and the second I-through hole, respectively, wherein the first radiation patch and the second feeding patch are stacked on an upper surface of the first base layer.

In the multilayer-type patch antenna, an imaginary line that connects the first I-through hole and a center point of the first radiation patch may have the predetermined angle in reference to an imaginary line that connects the second I-through hole and the center point of the first radiation patch.

The multilayer-type patch antenna may further include a first lower patch having a first III-through hole in a position corresponding to the first I-through hole and the first II-through hole and a second III-through hole in a position corresponding to the second I-through hole and the second II-through hole, the first lower patch being stacked on a lower surface of the first base layer.

The lower patch antenna portion may include: a second radiation patch having a third I-through hole and a fourth I-through hole in positions corresponding to the first through hole and the second through hole, respectively and having a fifth I-through hole spaced from the third I-through hole and the fourth I-through hole; and a second base layer which is a dielectric substrate or a magnetic substrate, has a third II-through hole and a fourth II-through hole in positions corresponding to the third I-through hole and the fourth I-through hole, respectively, and has a fifth II-through hole in a position corresponding to the fifth I-through hole, wherein the second base layer is stacked on a lower surface of the second radiation patch.

In the multilayer-type patch antenna, an imaginary line that connects the third I-through hole and a center point of the second radiation patch may have the predetermined angle in reference to an imaginary line that connects the fourth I-through hole and the center point of the second radiation patch.

The multilayer-type patch antenna may include a second lower patch having a third III-through hole in a position corresponding to the third I-through hole and the third II-through hole, a fourth III-through hole in a position corresponding to the fourth I-through hole and the fourth II-through hole, and a fifth III-through hole in a position corresponding to the fifth I-through hole and the fifth II-through hole, the second lower patch being stacked on a lower surface of the second base layer.

In order to accomplish the above object, the present invention provides a multilayer-type patch antenna including: an upper patch antenna portion having a lower surface within which a first feeding point and a second feeding point are spaced from each other and formed such that an angle between the first feeding point and the second feeding point in reference to a center point of the upper patch antenna portion is a predetermined angle; and a lower patch antenna portion having a lower surface within which a third feeding point and a fifth feeding portion are formed in positions corresponding to the first feeding point and the second feeding point, respectively and within which a fifth feeding point is formed to be spaced from the third feeding point and the fourth feeding point, the lower patch antenna portion being formed on the lower surface of the upper patch antenna portion.

In the multilayer-type patch antenna, an imaginary line that connects the first feeding point and a center point of the upper patch antenna portion may have the predetermined angle in reference to an imaginary line that connects the second feeding point and the center point of the upper patch antenna portion.

In the multilayer-type patch antenna, an imaginary line that connects the third feeding point and a center point of the lower patch antenna portion may have the predetermined angle in reference to an imaginary line that connects the fourth feeding point and the center point of the lower patch antenna portion.

The predetermined angle may be ranged from 70° to 110°.

The upper patch antenna portion may include: a first radiation patch; a first base layer which is a dielectric substrate or a magnetic substrate and is stacked on a lower surface of the first radiation patch; and a first lower patch having the first feeding point and the second feeding point in a lower surface thereof and being stacked on a lower surface of the first base layer, in which an angle between the first feeding point and the second feeding point in reference to a center point of the lower surface of the first lower patch is a predetermined angle.

In the multilayer-type patch antenna, an imaginary line that connects the first feeding point and the center point of the first lower patch may have the predetermined angle in reference to an imaginary line that connects the second feeding point and the center point of the first lower patch.

The upper patch antenna portion may include a first feeding patch and a second feeding patch which are disposed on an upper surface of the first base layer and spaced from the first radiation patch, in which an imaginary line that connects a center point of the first feeding patch and a center point of the first radiation patch has the predetermined angle in reference to an imaginary line that connects a center point of the second feeding patch and a center point of the first radiation patch.

Here, the first feeding point and the second feeding point may overlap the center point of the first feeding patch and the center point of the second feeding patch, respectively.

The lower patch antenna portion may include: a second radiation patch; a second base layer which is a dielectric substrate or a magnetic substrate and is stacked on a lower surface of the second radiation patch; and a second lower patch having a lower surface within which a third feeding point and a fourth feeding point are formed in positions corresponding to the first feeding point and the second feeding point, respectively and within which a fifth feeding point is spaced from the third feeding point and the fourth feeding point, the second lower patch being stacked on a lower surface of the second base layer.

Here, an imaginary line that connects the third feeding point and a center point of the second lower patch may have the predetermined angle in reference to an imaginary line that connects the fourth feeding point and the center point of the second lower patch.

According to the present invention, a multilayer-type patch antenna has a structure in which an antenna for receiving both GPS and GLONASS signals and an antenna for receiving an SDARS signal are stacked. With this structure, the multilayer-type patch antenna can receive all GPS, GLONASS, and SDARS signals while having advantages of a compact size and low production cost.

In addition, since the multilayer-type patch antenna has a structure in which a lower patch is formed on a side surface or a lower surface of a base layer, ultra-wide band reception which can receive all GPS and GLONASS signals can be enabled.

In addition, since the multilayer-type patch antenna has a structure in which a lower patch is formed on a side surface or a lower surface of a base layer, the multilayer-type patch antenna can be formed using a Surface Mount Devices (SMD) technology so that the multilayer-type patch antenna has advantages of a compact size and low production cost.

BRIEF DESCRIPTION OF THE DRAWINGS

The above and other objects, features and advantages of the present invention will be more clearly understood from the following detailed description taken in conjunction with the accompanying drawings, in which:

FIGS. 19 to 23 are diagrams describing GPS and/or GLONASS frequency characteristics of the multilayer-type patch antenna according to embodiments of the present invention.

FIGS. 24 to 30 are diagrams describing SDARS frequency characteristics of the multilayer-type patch antenna according to embodiments of the present invention.

DESCRIPTION OF THE PREFERRED EMBODIMENTS

Figure 1:
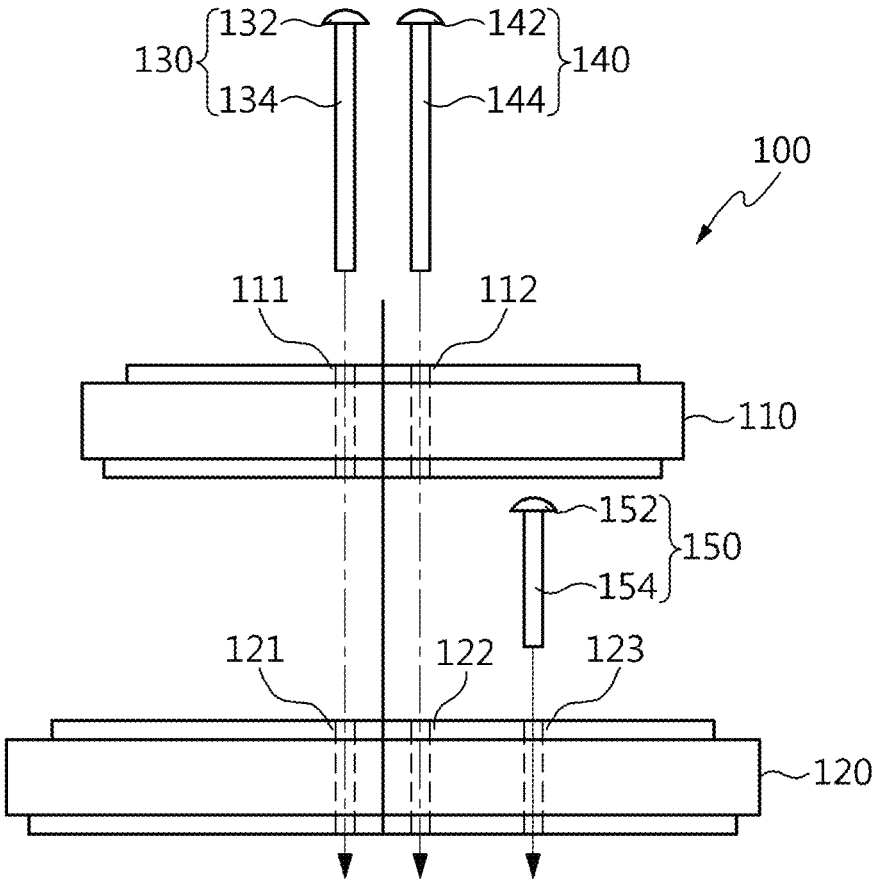
FIGS. 1 and 2 are diagrams describing a multilayer-type patch antenna according to a first embodiment.

Embodiments of the present invention will be described in detail with reference to the accompanying drawings. These embodiments will be described in detail in order to allow those skilled in the art to practice the present invention. Reference now should be made to the drawings, throughout which the same reference numerals are used to designate the same or similar components. In the description, details of well-known features and techniques may be omitted to avoid unnecessarily obscuring the presented embodiments.

Figure 2:
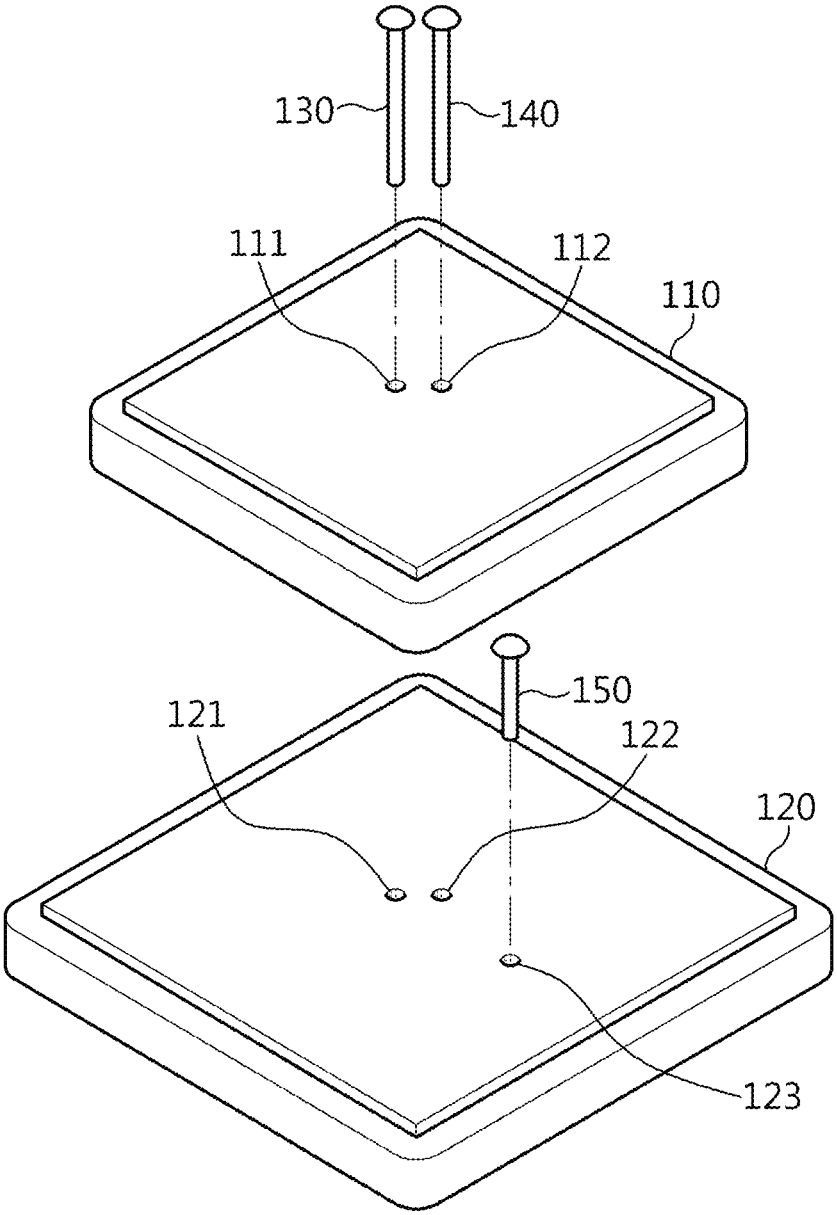
Figure 3:
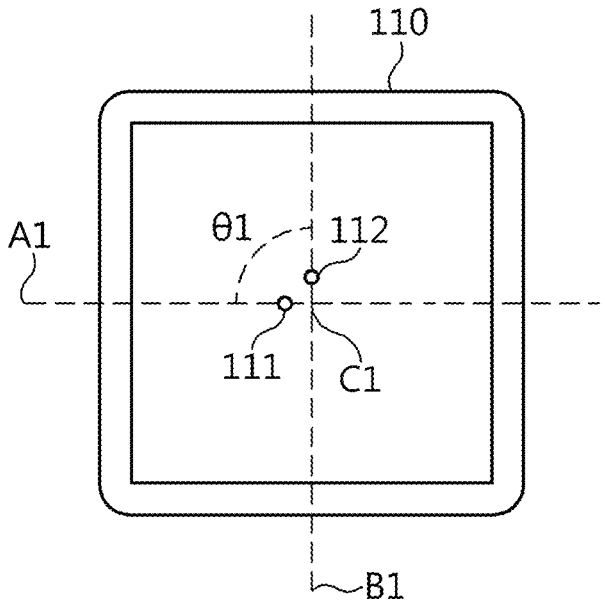
FIGS. 3 to 5 are diagrams describing an upper patch antenna portion illustrated in FIG. 1.
Figure 4:
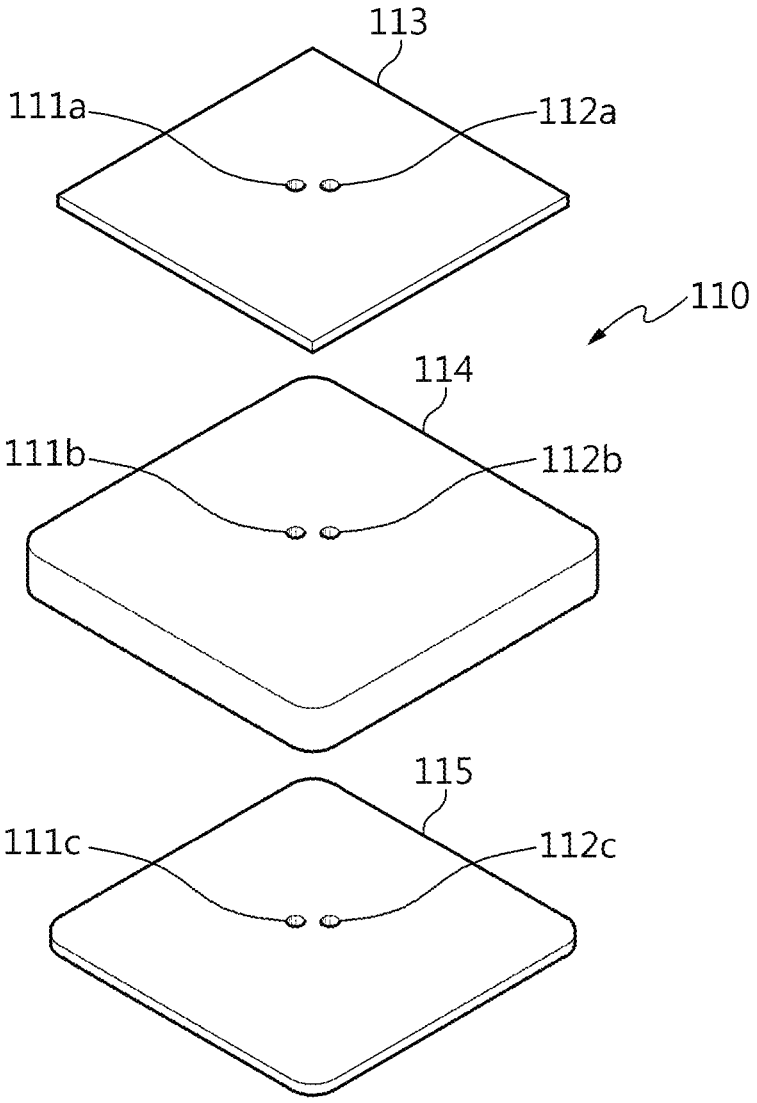
Figure 5:
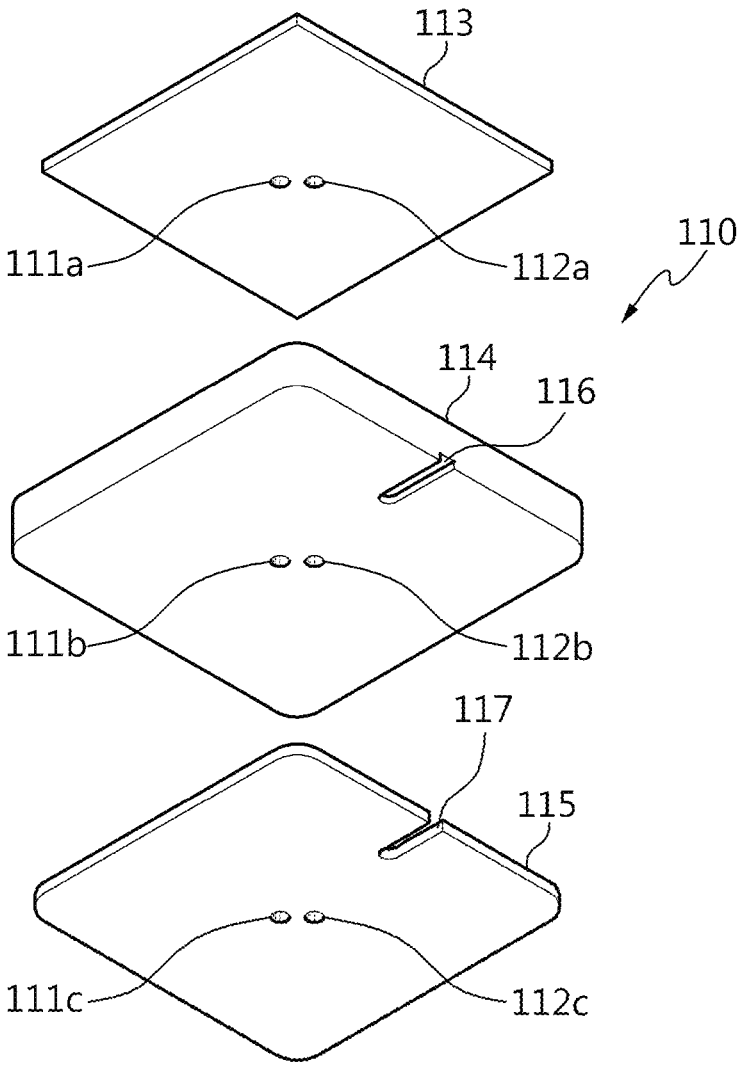
Figure 6:
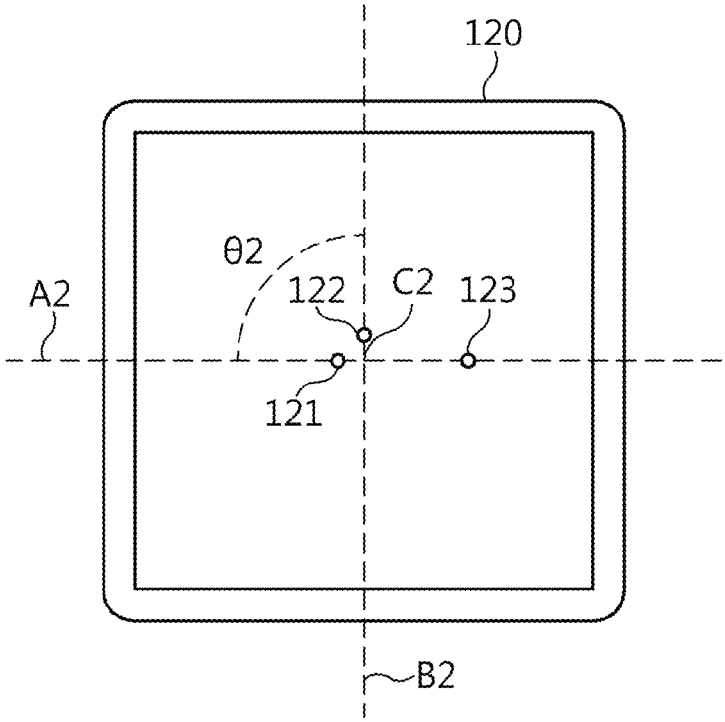
FIGS. 6 and 7 are diagrams describing a lower patch antenna portion illustrated in FIG. 1.
Figure 7:
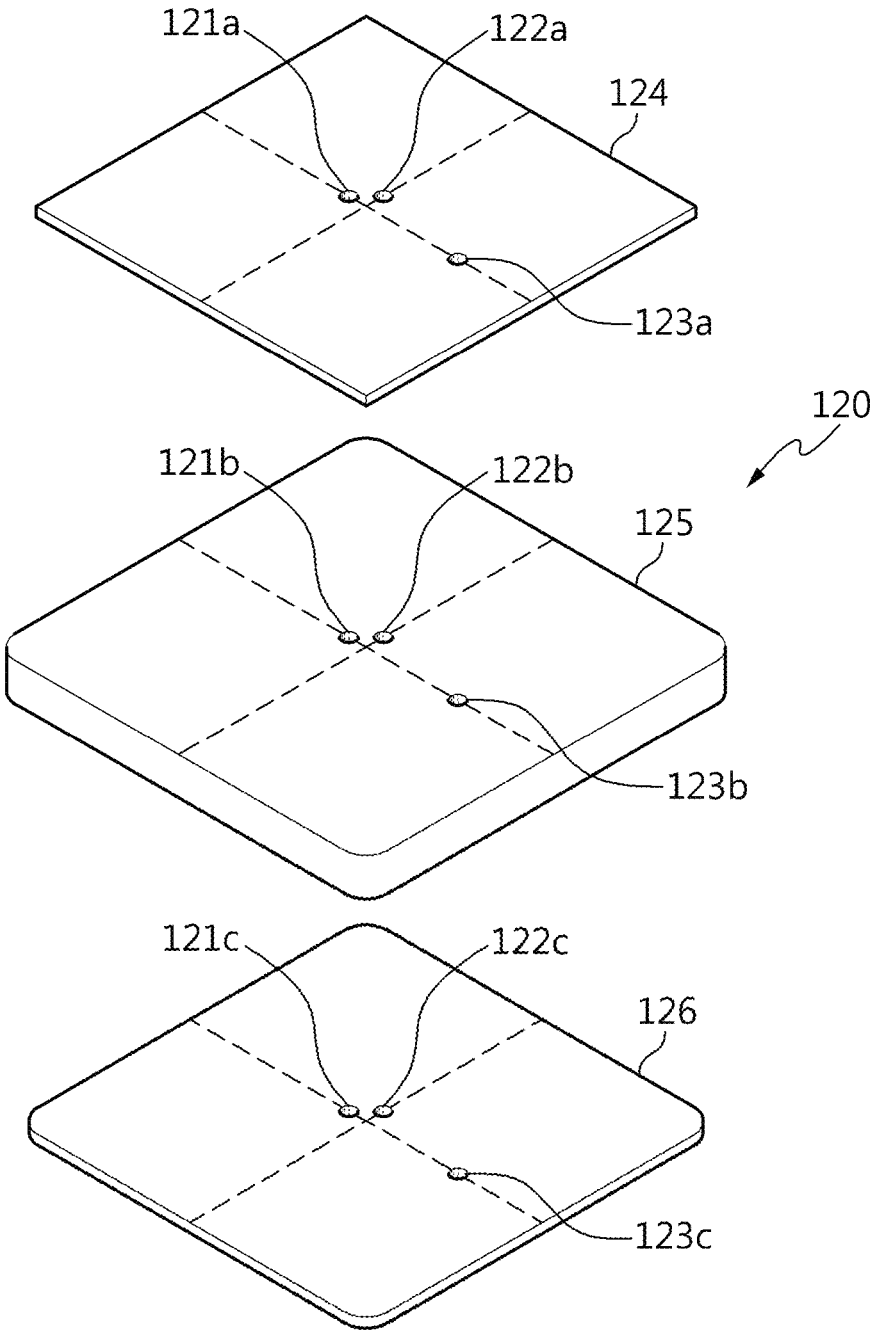

Hereinafter, a multilayer-type patch antenna according to a first embodiment of the present invention will be described in detail with reference to the accompanying drawings. FIGS. 1 and 2 are diagrams describing a multilayer-type patch antenna according to a first embodiment. FIGS. 3 to 5 are diagrams describing an upper patch antenna portion illustrated in FIG. 1. FIGS. 6 and 7 are diagrams describing a lower patch antenna portion illustrated in FIG. 1.

With reference to FIGS. 1 and 2, a multilayer-type patch antenna 100 includes an upper patch antenna portion 110, a lower patch antenna portion 120, a first feeding pin 130, a second feeding pin 140, and a third feeding pin 150.

The upper patch antenna portion 110 has a first through hole 111 and a second through hole 112. That is, the upper patch antenna portion 110 has the first through hole 111 through which the first feeding pin 130 passes and the second through hole 112 through which the second feeding pin 140 passes. In this case, as illustrated in FIG. 3, an imaginary line A1 that connects the first through hole 111 and a center point C1 of the upper patch antenna portion 110 is at a predetermined angle θ1 to an imaginary line B1 that connects the second through hole 112 and the center point C1 of the upper patch antenna portion 110. The predetermined angle θ1 is preferably set to 90°. Alternatively, it may be set to an angle within a range of from 70° to 110°.

As illustrated in FIG. 4, the upper patch antenna portion 110 includes a first radiation patch 113, a first base layer 114, and a first lower patch 115.

The first radiation patch 113 is a thin conductive plate made of a highly conductive material, such as copper, aluminum, gold, or silver, and is formed on an upper surface of the first base layer 114. The first radiation patch 113 is driven by power which is fed from the first feeding pin 130 and the second feeding pin 140, and the first radiation patch 113 receives signals within GPS and GLONASS frequency bands. In this case, the first radiation patch 113 has a circular shape or a polygonal shape such as a triangle, a rectangle, or an octagon.

The first radiation patch 113 has a first I-through hole 111*a* and a second I-through hole 112*a* which are arranged such that an angle between the first I-through hole 111*a* and the second I-through hole 112*a* in reference to a center point of the first radiation patch 113 is a predetermined angle. An imaginary line which connects the first I-through hole 111*a* and the center point of the first radiation patch 113 is at a predetermined angle, which is an angle within a range of from 70° to 110°, in reference to an imaginary line which connects the second I-through hole 112*a* and the center point of the first radiation patch 113.

The first base layer 114 is made of a dielectric material or a magnetic material. That is, the first base layer 114 is a dielectric substrate made of a ceramic material with high dielectric constant and low thermal expansion coefficient, or is a magnetic substrate made of a magnetic substance such as ferrite.

The first base layer 114 has a first II-through hole 111*b* and a second II-through hole 112*b*. That is, in the first base layer 114, the first II-through hole 111*b* is formed in a position corresponding to the first I-through hole 111*a* of the first radiation patch 113, and the second II-through hole 112*b* is formed in a position corresponding to the second I-through hole 112*a* of the first radiation patch 113. In the first base layer 114, the first II-through hole 111*b* and the second II-through hole 112*b* are arranged such that an angle between the first II-through hole 111*b* and the second II-through hole 112*b* in reference to a center point of the first base layer 114 is a predetermined angle, which is an angle within a range of from 70° to 110°.

The first lower patch 115 is a thin conductive plate made of a highly conductive material, such as copper, aluminum, gold, or silver, and is formed on a lower surface of the first base layer 114.

In this case, the first lower patch 115 has a first III-through hole 111*c* and a second III-through hole 112*c*. That is, in the first lower patch 115, the first III-through hole 111*c* is formed in a position corresponding to the first I-through hole 111*a* of the first radiation patch 113 and the first II-through hole 111*b* of the first base layer 114, and the second III-through hole 112*c* is formed in a position corresponding to the second I-through hole 112*a* of the first radiation patch 113 and the second II-through hole 112*b* of the first base layer 114. Therefore, in the first lower patch 115, the first III-through hole 111*c* and the second III-through hole 112*c* are formed such that an angle between the first III-through hole 111*c* and the second III-through hole 112*c* in reference to the center point of the first lower patch 115 is a predetermined angle, which is an angle within a range of from 70° to 110°.

As described above, the first I-through hole 111*a* in the first radiation patch 113, the first II-through hole 111*b* in the first base layer 114, and the first III-through hole 111*c* in the first lower patch 115 are formed in the same position.

Likewise, the second I-through hole 112*a* in the first radiation patch 113, the second II-through hole 112*b* in the first base layer 114, and the second III-through hole 112*c* in the first lower patch 115 are formed in the same position.

As illustrated in FIG. 5, the upper patch antenna portion 110 may have an accommodation portion. When the third feeding pin 150 is inserted into the lower patch antenna portion, a head portion of the third feeding pin 150 protrudes from an upper end of the lower patch antenna portion. The accommodation portion of the upper patch antenna portion 110 accommodates the head portion of the third feeding pin 150, thereby minimizing the thickness (height) of the multilayer-type patch antenna. To this end, the first base layer 114 has an accommodation recess 116 in a lower surface thereof, and the first lower patch 115 has an accommodation slot 117. The accommodation portion is formed by the accommodation recess 116 and the accommodation slot 117 so that the head portion of the protruded third feeding pin 150 is accommodated in the accommodation portion.

The lower patch antenna portion 120 has a third through hole 121 and a fourth through hole 122. That is, a portion of the first feeding pin 130, which passes through the first through hole 111 and protrudes from a lower end of the upper patch antenna portion 110, passes through the third through hole 121 formed in the lower patch antenna portion 120. A portion of the second feeding pin 140, which passes through the second through hole 112 and protrudes from the lower end of the upper patch antenna portion 110, passes through the forth through hole 122 formed in the lower patch antenna portion 120.

In this case, as illustrated in FIG. 6, an imaginary line A2 which connects the third through hole 121 and a center point C2 of the lower patch antenna portion 120 has a predetermined angle θ2 to an imaginary line B2 which connects the fourth through hole 122 and the center point C2 of the lower patch antenna portion 120. The predetermined angle θ2 is preferably set to 90°. Alternatively, it may be set to an angle within a range of from 70° to 110°.

The lower patch antenna portion 120 has a fifth through hole 123 which is spaced from the third through hole 121 and the fourth through hole 122. That is, the lower patch antenna portion 120 has the fifth through hole 123 through which the third feeding pin 150 passes and which is spaced from the third through hole 121 and the fourth through hole 122.

As illustrated in FIG. 7, the lower patch antenna portion includes a second radiation patch 124, a second base layer 125, and a second lower patch 126.

The second radiation patch 124 is a thin conductive plate made of a highly conductive material, such as copper, aluminum, gold, or silver, and is formed on an upper surface of the second base layer 125. The second radiation patch 124 is driven by power which is fed from the third feeding pin 150 and receives signals within an SDARS frequency band. In this case, the second radiation patch 124 has a circular shape or a polygonal shape such as a triangle, a rectangle, or an octagon.

The second radiation patch 124 has a third I-through hole 121*a* and a fourth I-through hole 122*a* which are arranged such that an angle between the third I-through hole 121*a* and the fourth I-through hole 122*a* in reference to the center point of the second radiation patch 124 is a predetermined angle. An imaginary line which connects the third I-through hole 121*a* and a center point of the second radiation patch 124 is at a predetermined angle, which is an angle within a range of from 70° to 110°, in reference to an imaginary line which connects the fourth I-through hole 122*a* and the center point of the second radiation patch 124.

The second radiation patch 124 has a fifth I-through hole 123*a* through which the third feeding pin 150 passes. In this case, the fifth I-through hole 123*a* is spaced from the third I-through hole 121*a* and the fourth I-through hole 122*a*.

The second base layer 125 is made of a dielectric material or a magnetic material. That is, the second base layer 125 is a dielectric substrate made of a ceramic substance with a high dielectric constant and low thermal expansion coefficient, or is a magnetic substrate made of a magnetic substance such as ferrite.

In this case, the second base layer 125 has a third II-through hole 121*b* and a fourth II-through hole 122*b*. That is, in the second base layer 125, the third II-through hole 121*b* is formed in a position corresponding to the third I-through hole 121*a* of the second radiation patch 124, and the fourth II-through hole 122*b* is formed in a position corresponding to the fourth I-through hole 122*a* of the second radiation patch 124. Therefore, in the second base layer 125, the third II-through hole 121*b* and the fourth II-through hole 122*b* are arranged such that an angle between the third II-through hole 121*b* and the fourth II-through hole 122*b* in reference to the center point of the second base layer 125 is a predetermined angle, which is an angle within a range of from 70° to 110°.

The second base layer 125 has a fifth II-through hole 123*b* through which the third feeding pin 150 passes. In this case, the fifth II-through hole 123*b* is spaced from the third II-through hole 121*b* and the fourth II-through hole 122*b*.

The second lower patch 126 is a thin conductive plate made of a highly conductive material, such as copper, aluminum, gold, or silver, and is formed on a lower surface of the second base layer 125.

The second lower patch 126 has a third III-through hole 121*c* and a fourth III-through hole 122*c*. That is, in the second lower patch 126, the third III-through hole 121*c* is formed in a position corresponding to the third I-through hole 121*a* of the second radiation patch 124 and the third II-through hole 121*b* of the second base layer 125, and the fourth III-through hole 122*c* is formed in a position corresponding to the fourth I-through hole 122*a* of the second radiation patch 124 and the fourth II-through hole 122*b* of the second base layer 125. Therefore, in the second lower patch 126, the third III-through hole 121*c* and the fourth III-through hole 122*c* are arranged such that an angle between the third III-through hole 121*c* and the fourth III-through hole 122*c* in reference to the center of the second lower patch 126 is a predetermined angle, which is an angle within a range of from 70° to 110°.

The second lower patch 126 has a fifth III-through hole 123*c* through which the third feeding pin 150 passes. In this case, the fifth III-through hole 123*c* is spaced from the third III-through hole 121*c* and the fourth III-through hole 122*c*.

As described above, the third I-through hole 121*a* in the second radiation patch 124, the third II-through hole 121*b* in the second base layer 125, and the third III-through hole 121*c* in the second lower patch 126 are formed in the same position, forming a third through hole 121 through which a portion of the first feeding pin 130, protruding from the lower end of the upper patch antenna 110, passes.

The fourth I-through hole 122*a* in the second radiation patch 124, the fourth II-through hole 122*b* in the second base layer 125, and the fourth III-through hole 122*c* in the second lower patch 126 are formed in the same position, forming a fourth through hole 122 through which a portion of the second feeding pin 140, protruding from the lower end of the upper patch antenna 110, passes.

The fifth I-through hole 123*a* in the second radiation patch 124, the fifth II-through hole 123*b* in the second base layer 125, and the fifth III-through hole 123*c* in the second lower patch 126 are formed in the same position, forming a fifth through hole 123 through which a portion of the third feeding pin 150 passes.

A portion of the first feeding pin 130 passes through the first through hole 111 and the third through hole 121 and protrudes from the lower end of the lower patch antenna 120. That is, the first feeding pin 130 includes a head 132 and a pin 134. A portion of the pin 134 passes through the first through hole 111 and the third through hole 121 and protrudes from the lower end of the lower patch antenna 120. A portion of the protruded pin 134 is connected to a power feeding portion (not shown) of a vehicle and hence supplied with power, and it supplies power to the first radiation patch 113 of the upper patch antenna 110.

A portion of the second feeding pin 140 passes through the second through hole 112 and the fourth through hole 122 and protrudes from the lower end of the lower patch antenna 120. The second feeding pin 140 includes a head 142 and a pin 144. A portion of the pin 144 passes through the second through hole 112 and the fourth through hole 122 and protrudes from the lower end of the lower patch antenna 120. A portion of the protruded pin 144 is connected to a power feeding portion (not shown) of a vehicle and is supplied with power, thereby transferring transfers power to the first radiation patch 113 of the upper patch antenna 110.

A portion of the third feeding pin 150 passes through the fifth through hole 123 and protrudes from the lower end of the lower patch antenna 120. The third feeding pin 150 includes a head 152 and a pin 154. A portion of the pin 154 passes through the fifth through hole 123 and protrudes from the lower end of the lower patch antenna 120. A portion of the protruded pin 154 is connected to a power feeding portion (not shown) of a vehicle and is supplied with power, thereby transferring power to the second radiation patch 124 of the lower patch antenna 120.

Figure 8:
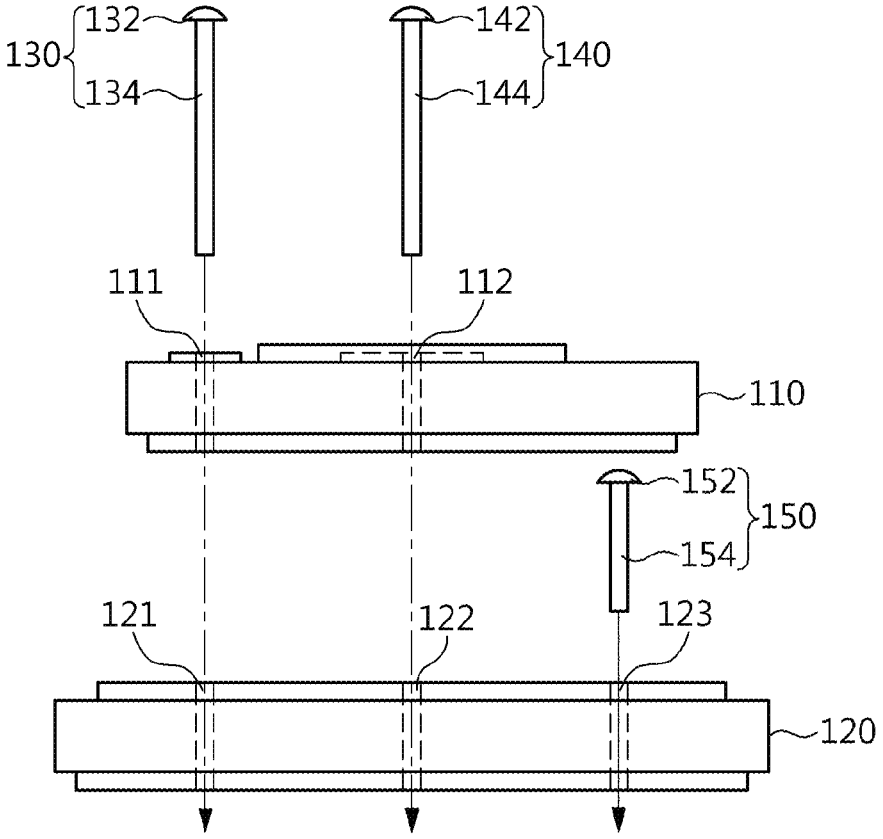
FIGS. 8 and 9 are diagrams describing a multilayer-type patch antenna according to a second embodiment.
Figure 9:
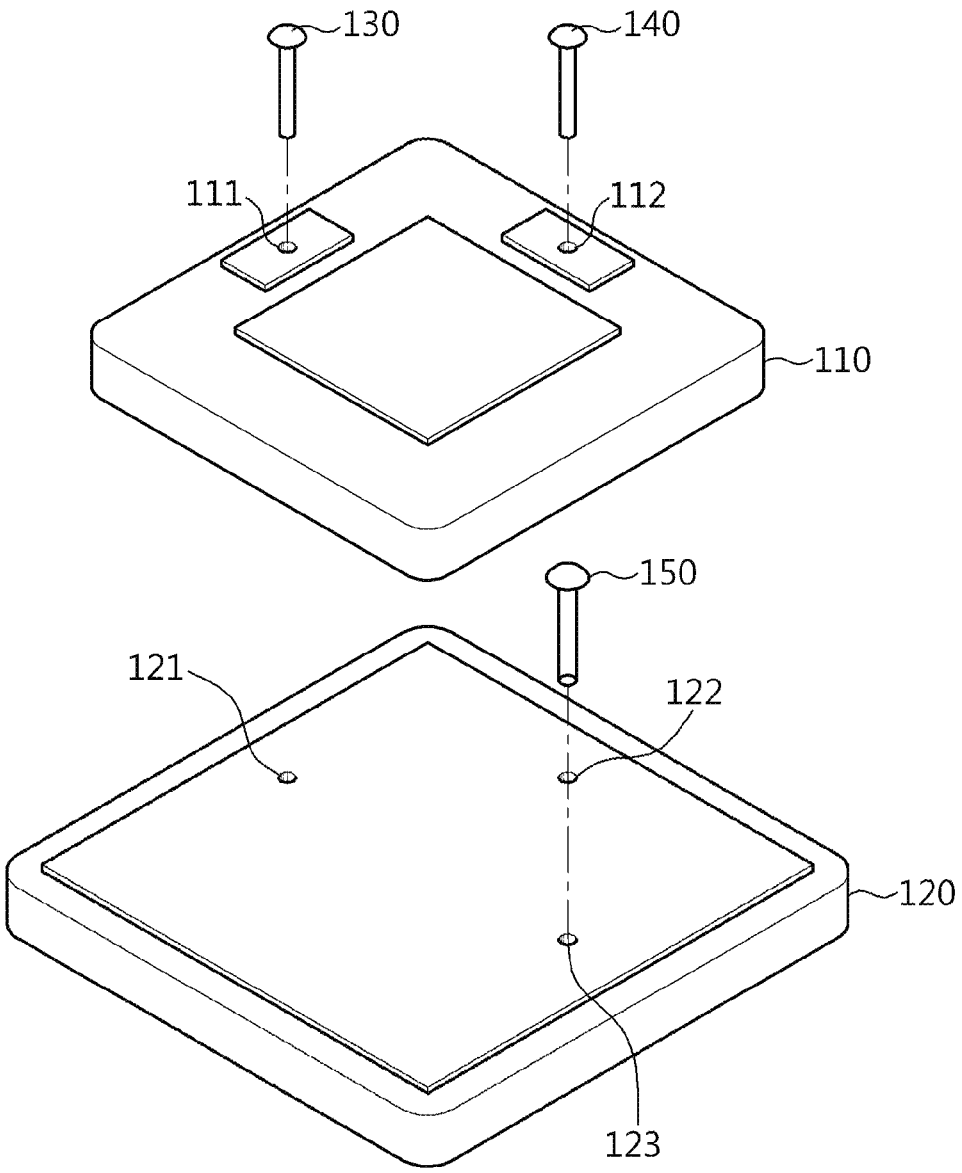
Figure 10:
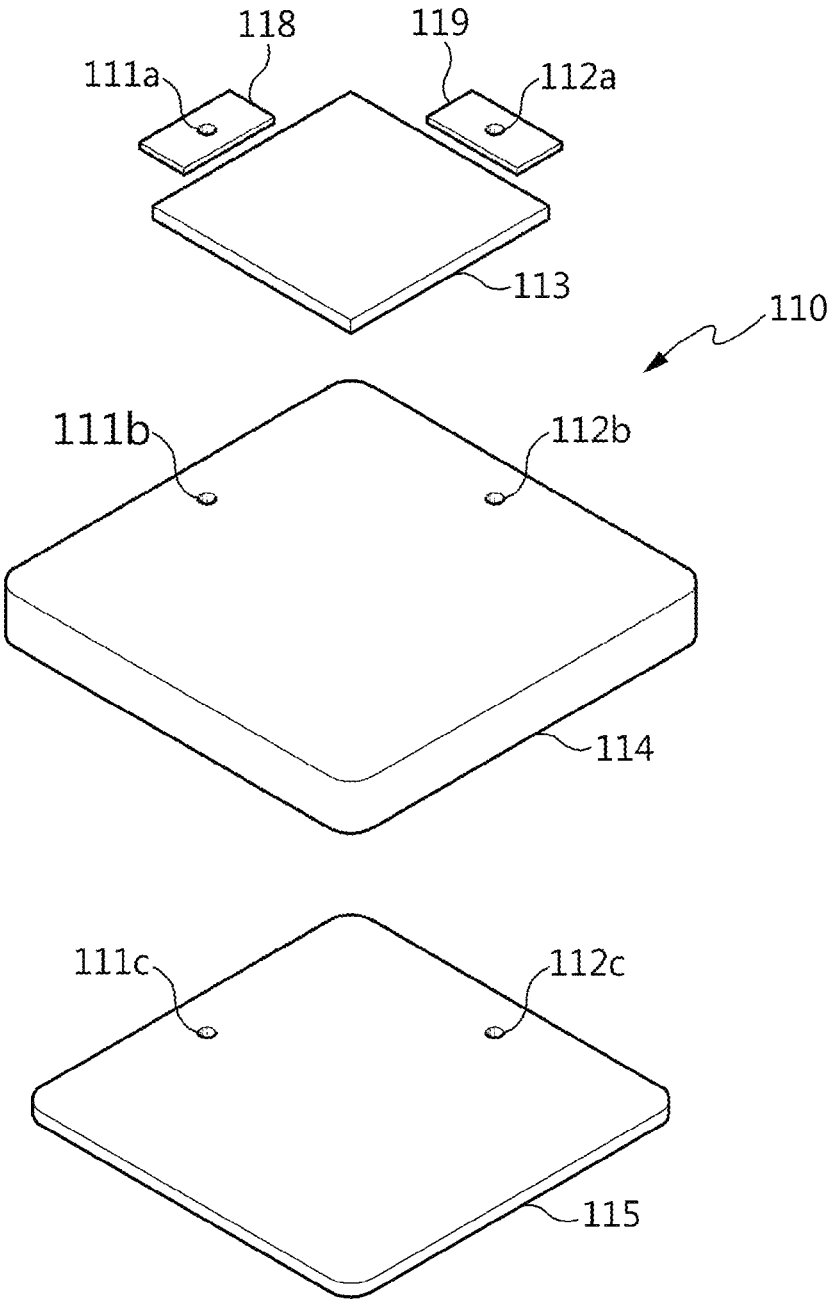
FIGS. 10 and 11 are diagrams describing an upper patch antenna portion illustrated in FIG. 8.
Figure 11:
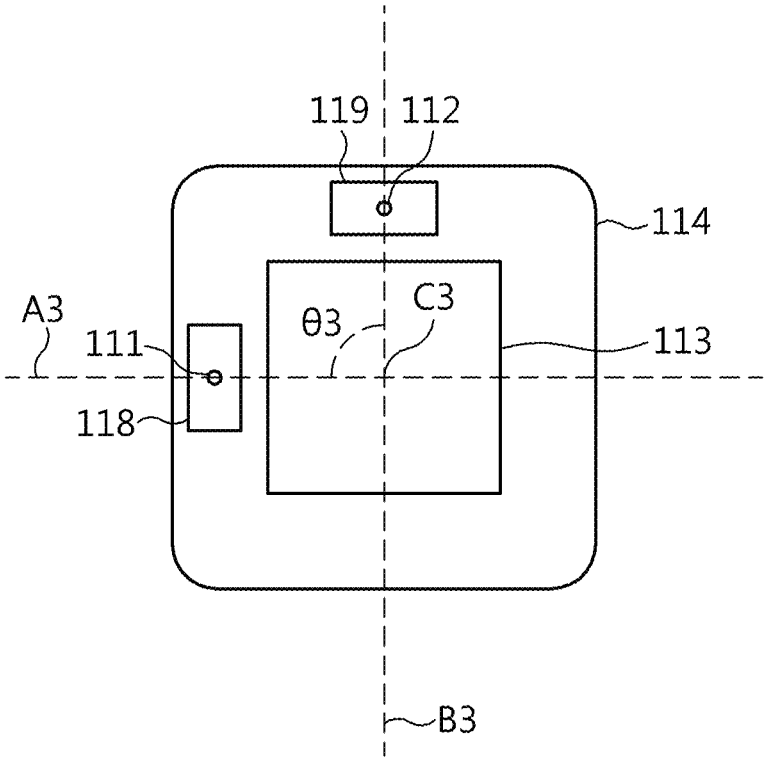
Figure 12:
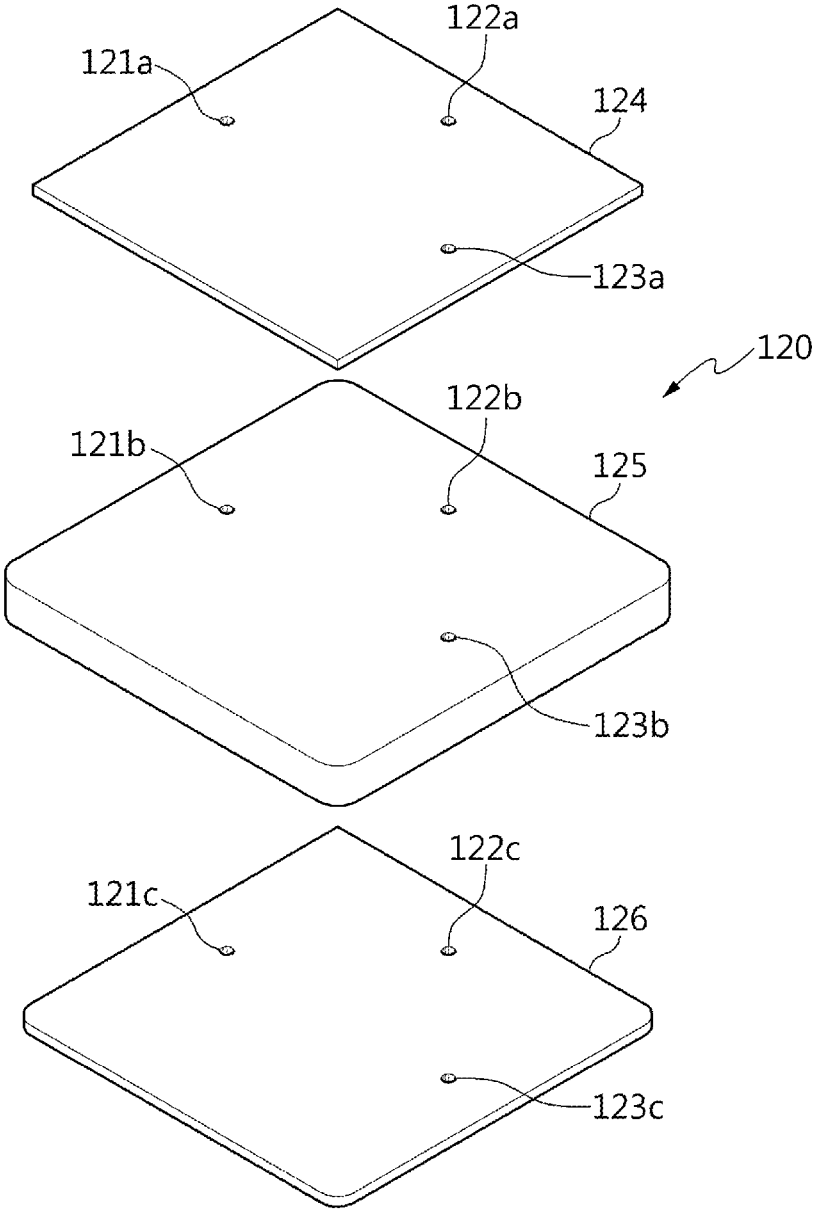
FIG. 12 is a diagram describing a lower patch antenna portion illustrated in FIG. 8.

Hereinafter, a multilayer-type patch antenna according to a second embodiment of the present invention will be described in detail with reference to the accompanying drawings. FIGS. 8 and 9 are diagrams describing a multi-layer-type patch antenna according to a second embodiment. FIGS. 10 to 11 are diagrams describing an upper patch antenna portion illustrated in FIG. 8; and FIG. 12 is a diagram describing a lower patch antenna portion illustrated in FIG. 8.

With reference to FIGS. 8 and 9, a multilayer-type patch antenna 100 includes an upper patch antenna portion 110, a lower patch antenna portion 120, a first feeding pin 130, a second feeding pin 140, and a third feeding pin 150.

The upper patch antenna portion 110 has a first through hole 111 and a second through hole 112. That is, the upper patch antenna portion 110 has the first through hole 111 through which the first feeding pin 130 passes and the second through hole 112 through which the second feeding pin 140 passes.

As illustrated in FIG. 10, the upper patch antenna portion 110 includes a first radiation patch 113, a first feeding patch 118, a second feeding patch 119, a first base layer 114, and a first lower patch 115.

The first radiation patch 113 is a thin conductive plate made of a highly conductive material, such as copper, aluminum, gold, or silver, and is formed on an upper surface of the first base layer 114. The first radiation patch 113 is driven by power which is fed through coupling feeding between the first feeding patch 118 and the second feeding patch 119, and the first radiation patch 113 receives signals within GPS and GLONASS frequency bands. In this case, the first radiation patch 113 has a circular shape or a polygonal shape such as a triangle, a rectangle, or an octagon.

The first feeding patch 118 is a thin conductive plate made of a highly conductive material, such as copper, aluminum, gold, or silver. The first feeding patch 118 is formed on the upper surface of the first base layer 114 and spaced from the first radiation patch 113. The second feeding patch 118 has a first I-through hole 111*a* through which the first feeding pin 130 passes.

The first feeding patch 118 is supplied with power from the first feeding pin 130 and supplies power to the first radiation patch 113 through coupling feeding between itself and the first radiation patch 113.

The second feeding patch 119 is a thin conductive plate made of a highly conductive material, such as copper, aluminum, gold, or silver. The second feeding patch 119 is formed on the upper surface of the first base layer 114 and spaced from the first radiation patch 113. The second feeding patch 119 has a second I-through hole 112*a* through which the second feeding pin 140 passes.

The second feeding patch 119 is supplied with power from the second feeding pin 140 and supplies power to the first radiation patch 113 through coupling feeding between itself and the first radiation patch 113.

In this case, as illustrated in FIG. 11, the first feeding patch 118 and the second feeding patch 119 are formed on two adjacent side surfaces of the first base layer 114, respectively so that the first I-through hole 111*a* in the first feeding patch 118 and the second I-through hole 112*a* in the second feeding patch 119 are at a predetermined angle. That is, an imaginary line A3 that connects the first I-through hole 111*a* and a center point C3 of the first radiation patch 113 has a predetermined angle θ3 to an imaginary line B3 that connects the second I-through hole 112*a* and the center point C3 of the first radiation patch 113. Here, the predetermined angle θ3 is preferably set to 90°. Alternatively, it may be set to an angle within a range of from 70° to 110°.

The first base layer 114 is made of a dielectric material or a magnetic material. That is, the first base layer 114 is a dielectric substrate made of a ceramic substance with high dielectric constant and low thermal expansion coefficient, or is a magnetic substrate made of a magnetic substance such as ferrite.

In this case, the first base layer 114 has a first II-through hole 111*b* and a second II-through hole 112*b*. That is, in the first base layer 114, the first II-through hole 111*b* is formed in a position corresponding to the first I-through hole 111*a* of the first radiation patch 113, and the second II-through hole 112*b* is formed in a position corresponding to the second I-through hole 112*a* of the first radiation patch 113. Therefore, in the first base layer 114, the first II-through hole 111*b* and the second II-through hole 112*b* are arranged such that an angle between the first II-through hole 111*b* and the second II-through hole 112*b* in reference to a center point of the first base layer 114 is a predetermined angle, which is an angle within a range of from 70° to 110°.

The first lower patch 115 is a thin conductive plate made of a highly conductive material, such as copper, aluminum, gold, or silver, and is formed on a lower surface of the first base layer 114.

In this case, the first lower patch 115 has a first III-through hole 111*c* and a second III-through hole 112*c*. That is, in the first lower patch 115, the first III-through hole 111*c* is formed in a position corresponding to the first I-through hole 111*a* of the first radiation patch 113 and the first II-through hole 111*b* of the first base layer 114, and the second III-through hole 112*c* is formed in a position corresponding to the second I-through hole 112*a* of the first radiation patch 113 and the second II-through hole 112*b* of the first base layer 114. Therefore, in the first lower patch 115, the first III-through hole 111*c* and the second III-through hole 112*c* are arranged such that an angle between the first III-through hole 111*c* and the second III-through hole 112*c* in reference to a center point of the first lower patch 115 is a predetermined angle, which is an angle within a range of from 70° to 110°.

As described above, the first I-through hole 111*a* in the first radiation patch 113, the first II-through hole 111*b* in the first base layer 114, and the first III-through hole 111*c* in the first lower patch 115 are formed in the same position.

Likewise, the second I-through hole 112*a* in the first radiation patch 113, the second II-through hole 112*b* in the first base layer 114, and the second III-through hole 112*c* in the first lower patch 115 are formed in the same position.

Herein, the upper patch antenna portion 110 may have an accommodation portion. When the third feeding pin 150 is inserted into the lower patch antenna portion, a head portion of the third feeding pin 150 protrudes from an upper end of the lower patch antenna portion. The accommodation portion of the upper patch antenna portion 110 accommodates the head portion of the protruded third feeding pin 150, thereby minimizing the thickness (height) of the multilayer-type patch antenna. To this end, the first base layer 114 has an accommodation recess 116 in a lower surface thereof; and the first lower patch 115 has an accommodation slot 117. The accommodation portion is formed by the accommodation recess 116 and the accommodation slot 117 so that the head portion of the protruded third feeding pin 150 is accommodated in the accommodation portion.

The lower patch antenna portion 120 has a third through hole 121 and a fourth through hole 122. That is, a portion of the first feeding pin 130 which passes through the first through hole 111 and protrudes from a lower end of the upper patch antenna portion 110 passes through the third through hole 121 formed in the lower patch antenna portion 120. A portion of the second feeding pin 140 which passes through the second through hole 112 and protrudes from the lower end of the upper patch antenna portion 110 passes through the forth through hole 122 formed in the lower patch antenna portion 120.

The lower patch antenna portion 120 has a fifth through hole 123 which is spaced from the third through hole 121 and the fourth through hole 122. The third feeding pin 150 passes through the fifth through hole 123 which is formed in the lower patch antenna portion 120 and spaced from the third through hole 121 and the fourth through hole 122.

As illustrated in FIG. 12, the lower patch antenna portion includes a second radiation patch 124, a second base layer 125, and a second lower patch 126.

The second radiation patch 124 is a thin conductive plate made of a highly conductive material, such as copper, aluminum, gold, or silver, and is formed on an upper surface of the second base layer 125. The second radiation patch 124 is driven by power which is fed from the third feeding pin 150 and receives a signal within an SDARS frequency band. In this case, the second radiation patch 124 has a circular shape or a polygonal shape such as a triangle, a rectangle, or an octagon.

The second radiation patch 124 has a third I-through hole 121*a* and a fourth I-through hole 122*a* which are arranged such that an angle between the third I-through hole 121*a* and the fourth I-through hole 122*a* in reference to a center point of the second radiation patch 124 is a predetermined angle. An imaginary line which connects the third I-through hole 121*a* and a center point of the second radiation patch 124 is at a predetermined angle, which is an angle within a range of from 70° to 110°, in reference to an imaginary line which connects the fourth I-through hole 122*a* and the center point of the second radiation patch 124.

The second radiation patch 124 has a fifth I-through hole 123*a* through which the third feeding pin 150 passes. In this case, the fifth I-through hole 123*a* is spaced from the third I-through hole 121*a* and the fourth I-through hole 122*a*.

The second base layer 125 is made of a dielectric material or a magnetic material. That is, the second base layer 125 is a dielectric substrate made of a ceramic substance with a high dielectric constant and low thermal expansion coefficient, or is a magnetic substrate made of a magnetic substance such as ferrite.

The second base layer 125 has a third II-through hole 121*b* and a fourth II-through hole 122*b*. That is, in the second base layer 125, the third II-through hole 121*b* is formed in a position corresponding to the third I-through hole 121*a* of the second radiation patch 124, and the fourth II-through hole 122*b* is formed in a position corresponding to the fourth I-through hole 122*a* of the second radiation patch 124. Therefore, in the second base layer 125, the third II-through hole 121*b* and the fourth II-through hole 122*b* are arranged such that an angle between the third II-through hole 121*b* and the fourth II-through hole 122*b* in reference to a center point of the second base layer 125 is a predetermined angle, which is an angle within a range of from 70° to 110°.

The second base layer 125 has a fifth II-through hole 123*b* through which the third feeding pin 150 passes. In this case, the fifth II-through hole 123*b* is spaced from the third II-through hole 121*b* and the fourth II-through hole 122*b*.

The second lower patch 126 is a thin conductive plate made of a highly conductive material, such as copper, aluminum, gold, or silver, and is formed on a lower surface of the second base layer 125.

The second lower patch 126 has a third III-through hole 121*c* and a fourth III-through hole 122*c*. That is, in the second lower patch 126, the third III-through hole 121*c* is formed in a position corresponding to the third I-through hole 121*a* of the second radiation patch 124 and the third II-through hole 121*b* of the second base layer 125, and the fourth III-through hole 122*c* is formed in a position corresponding to the fourth I-through hole 122*a* of the second radiation patch 124 and the fourth II-through hole 122*b* of the second base layer 125. In this case, in the second lower patch 126, the third III-through hole 121*c* and the fourth III-through hole 122*c* are arranged such that an angle between the third III-through hole 121*c* and the fourth III-through hole 122*c* in reference to a center point of the second lower patch 126 is a predetermined angle, which is an angle within a range of from 70° to 110°.

The second lower patch 126 has a fifth III-through hole 123*c* through which the third feeding pin 150 passes. In this case, the fifth III-through hole 123*c* is spaced from the third III-through hole 121*c* and the fourth III-through hole 122*c*.

As described above, the third I-through hole 121*a* in the second radiation patch 124, the third II-through hole 121*b* in the second base layer 125, and the third III-through hole 121*c* in the second lower patch 126 are formed in the same position, forming a third through hole 121 through which a portion of the first feeding pin 130, protruding from the lower end of the upper patch antenna 110, passes.

The fourth I-through hole 122*a* in the second radiation patch 124, the fourth II-through hole 122*b* in the second base layer 125, and the fourth III-through hole 122*c* in the second lower patch 126 are formed in the same position, forming a fourth through hole 122 through which a portion of the second feeding pin 140, protruding from the lower end portion of the upper patch antenna 110, passes.

The fifth I-through hole 123*a* in the second radiation patch 124, the fifth II-through hole 123*b* in the second base layer 125, and the fifth III-through hole 123*c* in the second lower patch 126 are formed in the same position, forming a fifth through hole 123 through which a portion of the third feeding pin 150 passes.

A portion of the first feeding pin 130 passes through the first through hole 111 and the third through hole 121 and protrudes from the lower end of the lower patch antenna portion 120. The first feeding pin 130 includes a head 132 and a pin 134. A portion of the pin 134 passes through the first through hole 111 and the third through hole 121 and protrudes from the lower end of the lower patch antenna portion 120. A portion of the protruded pin 134 is connected to a power feeding portion (not shown) of a vehicle and is supplied with power, thereby transferring power to the first feeding patch 118 of the upper patch antenna portion 110.

A portion of the second feeding pin 140 passes through the second through hole 112 and the fourth through hole 122 and protrudes from the lower end of the lower patch antenna portion 120. The second feeding pin 140 includes a head 142 and a pin 144. A portion of the pin 144 passes through the second through hole 112 and the fourth through hole 122 and protrudes from the lower end of the lower patch antenna portion 120. A portion of the protruded pin 144 is connected to a power feeding portion (not shown) of a vehicle and is supplied with power, thereby transferring power to the second feeding patch 119 of the upper patch antenna portion 110.

A portion of the third feeding pin 150 passes through the fifth through hole 123 and protrudes from the lower end of the lower patch antenna portion 120. The third feeding pin 150 includes a head 152 and a pin 154. A portion of the pin 154 passes through the fifth through hole 123 and protrudes from the lower end of the lower patch antenna portion 120. A portion of the protruded pin 154 is connected to a power feeding portion (not shown) of a vehicle and is supplied with power, thereby transferring power to the second radiation patch 124 of the lower patch antenna portion 120.

Figure 13:
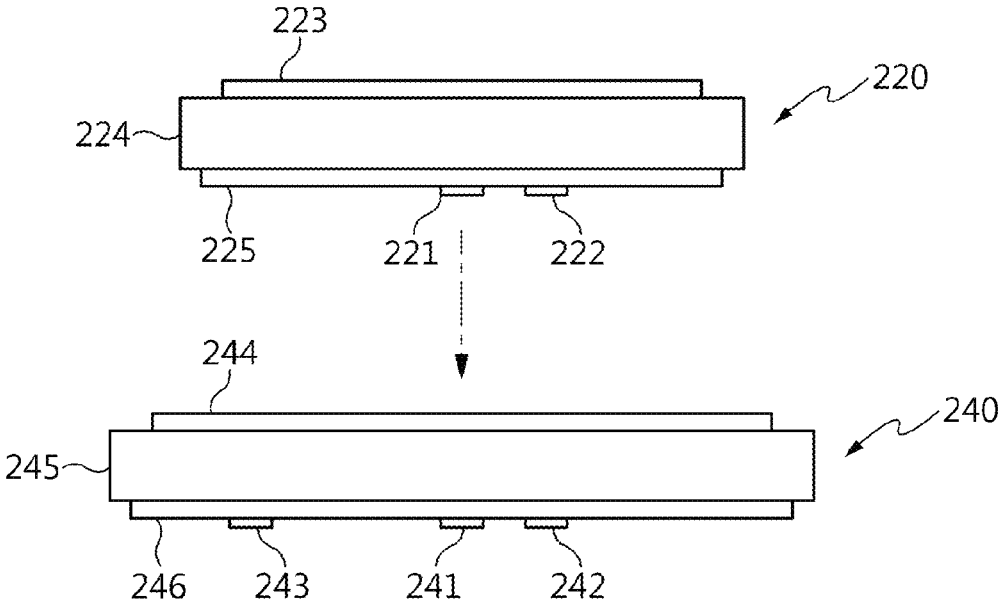
FIGS. 13 and 14 are diagrams describing a multilayer-type patch antenna according to a third embodiment.
Figure 14:
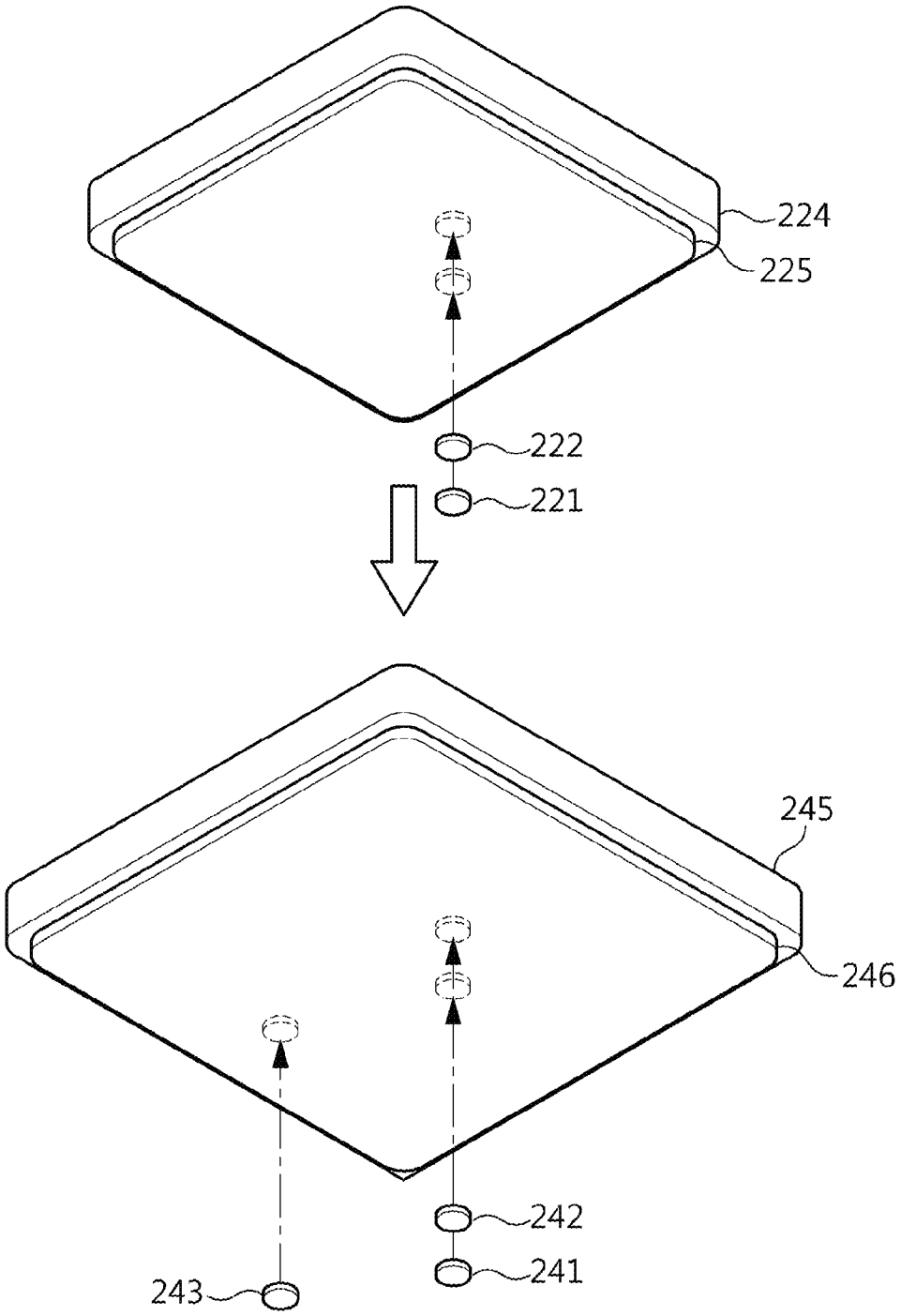
Figure 15:
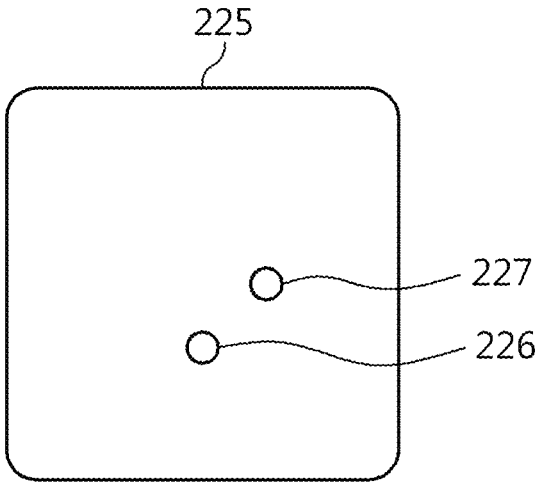
FIG. 15 is a diagram describing an upper patch antenna portion illustrated in FIG. 13.
Figure 16:
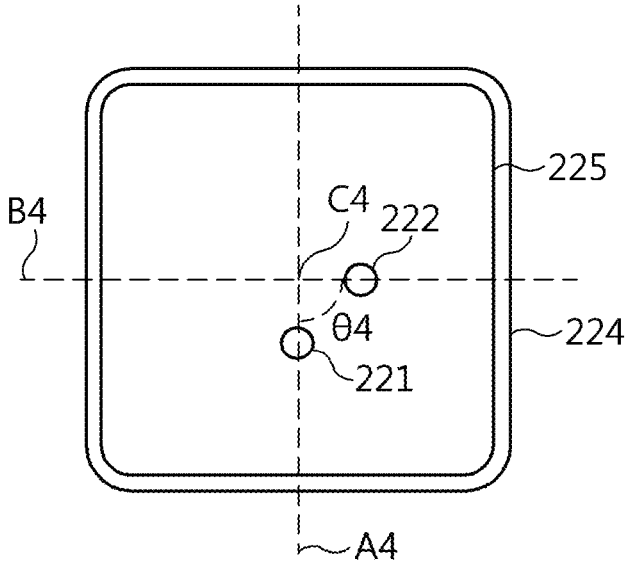
FIG. 16 is a diagram describing a first feeding point and a second feeding point illustrated in FIG. 13.
Figure 17:
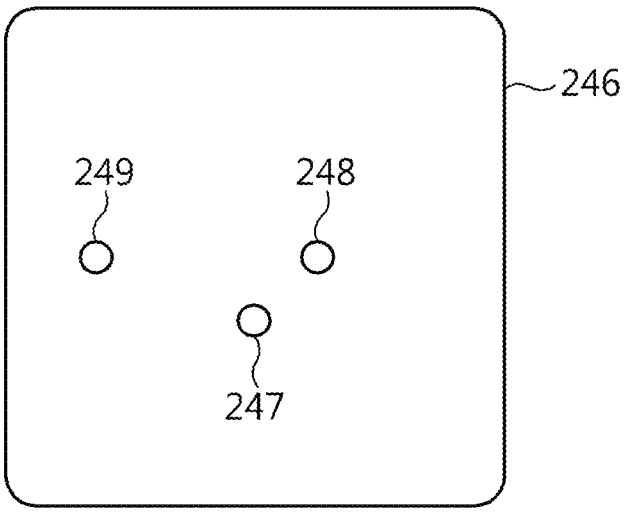
FIGS. 17 and 18 are diagrams describing a lower patch portion illustrated in FIG. 13.
Figure 18:
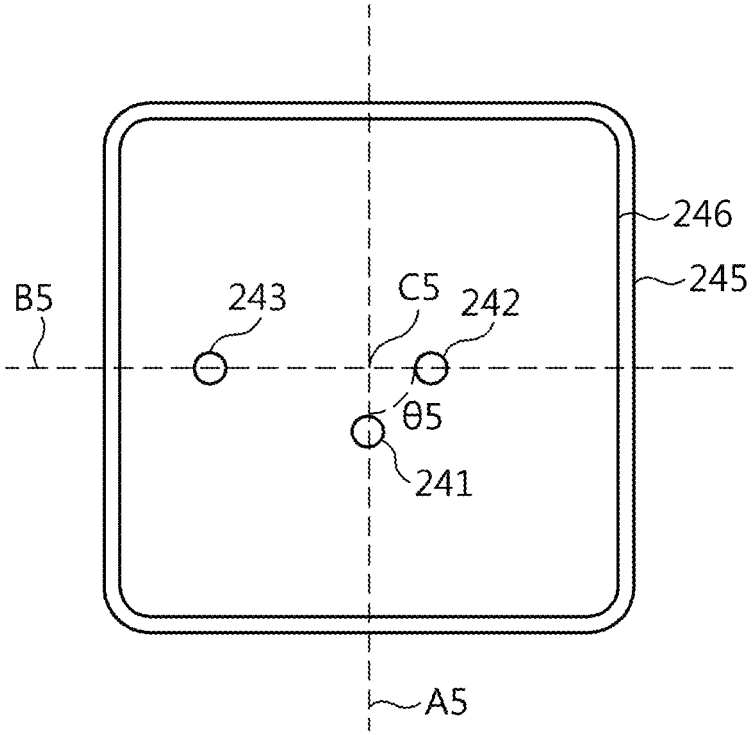

Hereinafter, a multilayer-type patch antenna according to a third embodiment of the present invention will be described in detail with reference to the accompanying drawings. FIGS. 13 and 14 are diagrams describing a multilayer-type patch antenna according to a third embodiment. FIG. 15 is a diagram describing an upper patch antenna portion illustrated in FIG. 13; FIG. 16 is a diagram describing a first feeding point and a second feeding point illustrated in FIG. 13; and FIGS. 17 and 18 are diagrams describing a lower patch portion illustrated in FIG. 13.

With reference to FIGS. 13 and 14, a multilayer-type patch antenna 200 includes an upper patch antenna portion 220 and a lower patch antenna portion 240.

The upper patch antenna portion 220 receives signals within GPS and GLONASS frequency bands. To this end, the upper patch antenna portion 220 includes a first radiation patch 223, a first base layer 224, a first lower patch 225, a first feeding point 221, and a second feeding point 222.

The first radiation patch 223 is a thin conductive plate made of a highly conductive material, such as copper, aluminum, gold, or silver, and is formed on an upper surface of the first base layer 224. The first radiation patch 223 is driven by power which is fed through coupling feeding between the first feeding point 221 and the second feeding point 222, and the first radiation patch 223 receives signals within GPS and GLONASS frequency bands. In this case, the first radiation patch 223 has a circular shape or a polygonal shape such as a triangle, a rectangle, or an octagon.

The first base layer 224 is made of a dielectric material or a magnetic material. That is, the first base layer 224 is a dielectric substrate made of a ceramic substance with a high dielectric constant and low thermal expansion coefficient, or is a magnetic substrate made of a magnetic substance such as ferrite.

The first lower patch 225 is a thin conductive plate made of a highly conductive material, such as copper, aluminum, gold, or silver, and is formed on a lower surface of the first base layer 224.

In this case, the first lower patch 225 may have a feeding recess. That is, as illustrated in FIG. 15, the first lower patch 225 has a first feeding recess 226 in which the first feeding point 221 is inserted and a second feeding recess 227 in which the second feeding point 222 is inserted.

The first feeding point 221 is formed in a lower surface of the first lower patch 225. The first feeding point 221 may take the form in which it is inserted in the first feeding recess 226 of the first lower patch 225. In this case, the first feeding point 221 is spaced from a circumference of the first feeding recess 226 by a predetermined distance.

The first feeding point 221 is supplied with power through coupling feeding between itself and the third feeding point 241 and supplies power to the first radiation patch 223 through coupling feeding between itself and the first radiation patch 223.

The second feeding point 222 is formed in a lower surface of the first lower patch 225. The second feeding point 222 may take the form in which it is inserted in the second feeding recess 227 of the first lower patch 225. In this case, the second feeding point 222 is spaced from the circumference of the second feeding recess 227 by a predetermined distance.

The second feeding point 222 is supplied with power through coupling feeding between itself and the third feeding point 242 and supplies power to the first radiation patch 223 through coupling feeding between itself and the first radiation patch 223.

Here, the first feeding point 221 and the second feeding point 222 are arranged to be at a predetermined angle to the center of the first lower patch 225. That is, as illustrated in FIG. 16, an imaginary line A4 which connects the first feeding point 221 and a center point C4 of the first lower patch is at a predetermined angle θ4 to an imaginary line B4 which connects the second feeding point 222 and the center point C4 of the first lower patch 225. Here, the predetermined angle θ4 is preferably set to 90°. Alternatively, it may be set to an angle within a range of from 70° to 110°.

The lower patch antenna portion 240 is layered under the upper patch antenna portion 220 to receive signals within an SDARS frequency band. To this end, the lower patch antenna portion 240 includes a second radiation patch 244, a second base layer 245, a second lower patch 246, a third feeding point 241, a fourth feeding point 242, and a fifth feeding point 243. In this case, the third feeding point 241 and the fourth feeding point 242 are formed in positions corresponding to the first feeding point 221 and the second feeding point 222, respectively, and are at a predetermined angle. The fifth feeding point 243 is spaced from the third feeding point 241 and the fourth feeding point 242 by a predetermined distance.

The second radiation patch 244 is a thin conductive plate made of a highly conductive material, such as copper, aluminum, gold, or silver, and is formed on an upper surface of the second base layer 245. The second radiation patch 244 is driven by power which is fed through coupling feeding between itself and the fifth feeding pin 243 and receives signals within an SDARS frequency band. In this case, the second radiation patch 244 has a circular shape or a polygonal shape such as a triangle, a rectangle, or an octagon.

The second base layer 245 is made of a dielectric material or a magnetic material. That is, the second base layer 245 is a dielectric substrate made of a ceramic substance with a high dielectric constant and low thermal expansion coefficient, or is a magnetic substrate made of a magnetic substance such as ferrite.

The second lower patch 246 is a thin conductive plate made of a highly conductive material, such as copper, aluminum, gold, or silver, and is formed on a lower surface of the second base layer 245.

In this case, the second lower patch 246 may have a feeding recess. That is, as illustrated in FIG. 17, the second lower patch 246 has a third feeding recess 247 in which the third feeding point 241 is inserted, a fourth feeding recess 246 in which the fourth feeding point 242 is inserted, and a fifth feeding recess 249 in which the fifth feeding point 243 is inserted.

The third feeding point 241 is formed in a lower surface of the second lower patch 246. The third feeding point 241 may take the form in which it is inserted in the third feeding recess 247 in the second lower patch 246. In this case, the second feeding point 241 is spaced from the circumference of the third feeding recess 247 by a predetermined distance. The third feeding point 241 is connected to a power feeding portion (not shown) of a vehicle and is supplied with power, thereby transferring power to the first feeding point 221 through coupling feeding between itself and the first feeding point 221.

The fourth feeding point 242 is formed in a lower surface of the second lower patch 246. The fourth feeding point 242 may take the form in which it is inserted in the fourth feeding recess 248 in the second lower patch 246. In this case, the fourth feeding point 242 is spaced from the circumference of the fourth feeding recess 248 by a predetermined distance. The fourth feeding point 242 is connected to a power feeding portion (not shown) of a vehicle and is supplied with power, thereby transferring power to the second feeding point 222 through coupling feeding between itself and the second feeding point 222.

The fifth feeding point 243 is formed in the lower surface of the second lower patch 246. The fifth feeding point 243 may take the form in which it is inserted in the fifth feeding recess 249 formed in the second lower patch 246. In this case, the fifth feeding point 243 is spaced from the circumference of the fifth feeding recess 249 by a predetermined distance. The fifth feeding point 243 is connected to a power feeding portion (not shown) of a vehicle and is supplied with power, thereby transferring power to the second radiation patch 244 through coupling feeding between itself and the second radiation patch 244.

Here, the third feeding point 241 and the fourth feeding point 242 are arranged to have a predetermined angle in reference to the center of the second lower patch 246. That is, as illustrated in FIG. 18, an imaginary line A5 which connects the third feeding point 241 and a center point C5 of the second lower patch has a predetermined angle θ5 in reference to an imaginary line B5 which connects the fourth feeding point 242 and the center point C5 of the second lower patch 246. Here, the predetermined angle θ5 is preferably set to 90°. Alternatively, it may be set to an angle within a range of from 70° to 110°.

Hereinafter, features of the multilayer-type patch antennas according to the embodiments of the present invention will be described in detail with reference to the accompanying drawings.

FIGS. 19 to 23 are diagrams describing GPS or GLONASS or both frequency characteristics of the multilayer-type patch antennas according to the embodiments of the present invention.

Figure 19:
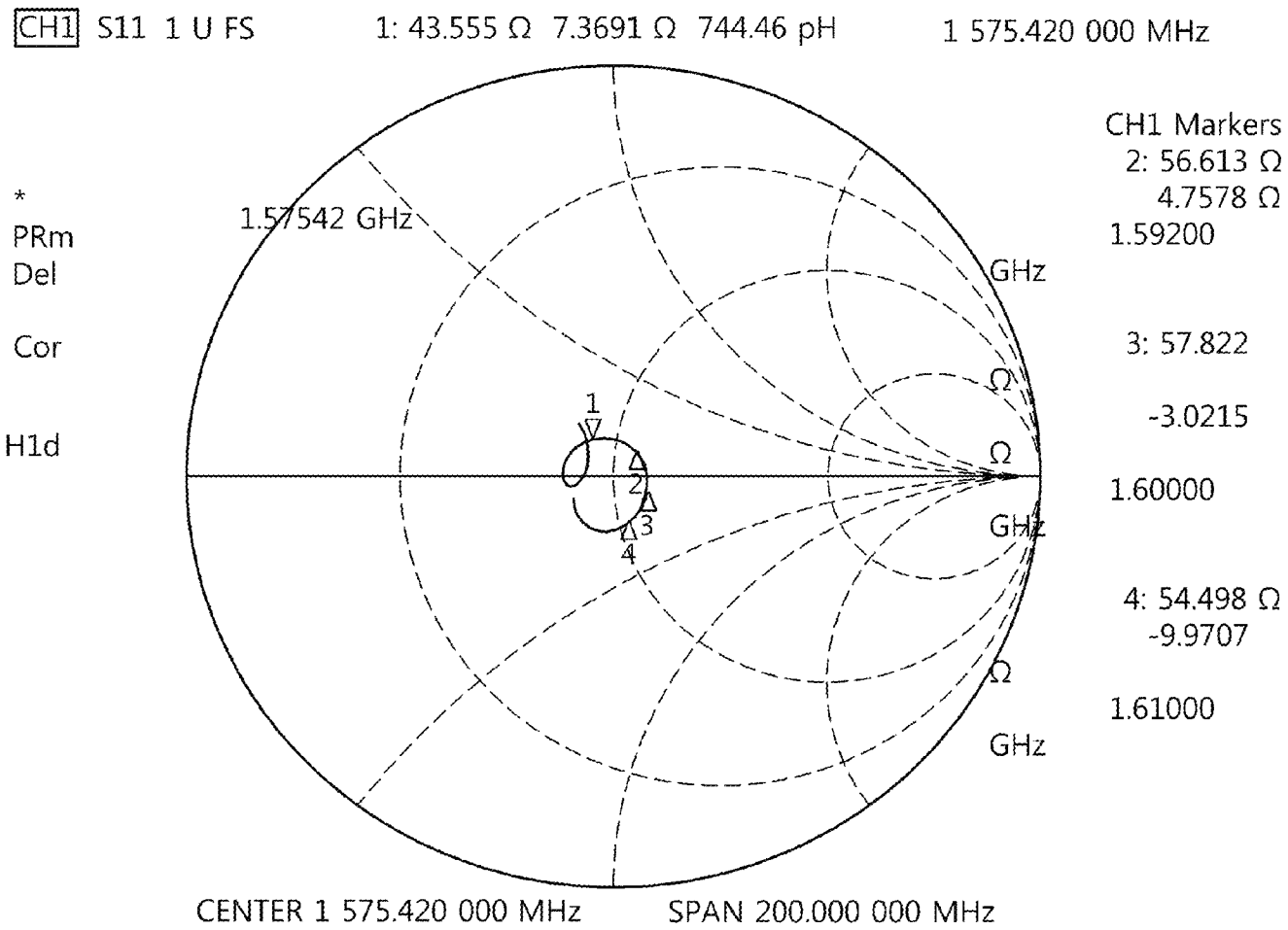

FIG. 19 is a Smith chart describing S11 characteristics of a multilayer-type patch antenna according to one embodiment of the present invention. The behavior in FIG. 19 occurs when characteristic impedance is 50 ohms for frequencies of from 1575 to 1608 MHz.

Figure 20:
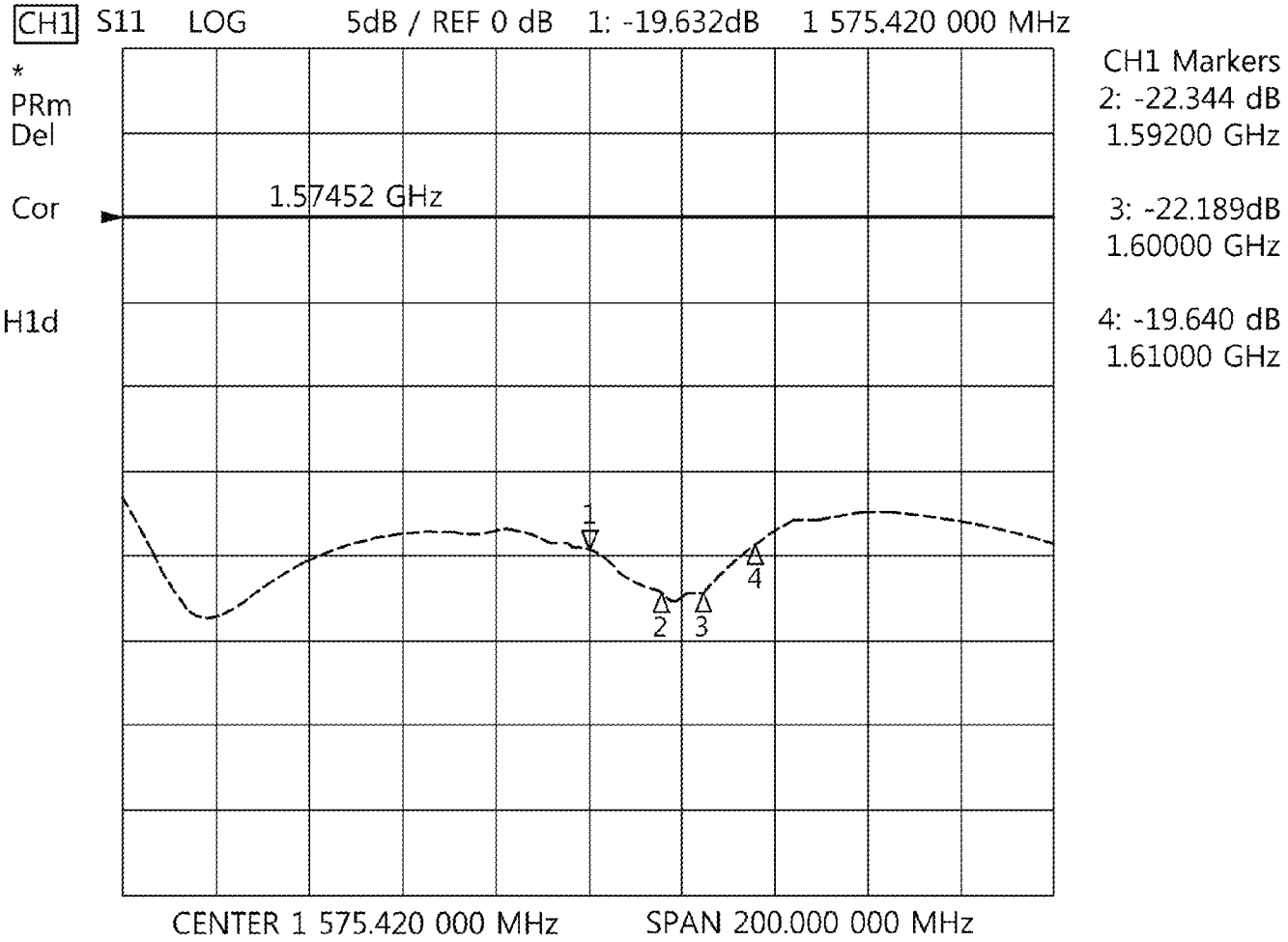

FIG. 20 is a log mg chart describing return loss and bandwidth of a multilayer-type patch antenna according to one embodiment of the present invention. FIG. 20 shows that the return loss is about 19.6 dB for 1575 MHz, 22.1 dB for 1592 MHz, and 19.6 dB for 1608 MHz. That is, the return loss is 19.6 db or more for the full band, 1575 to 1608 MHz. Furthermore, the frequency band in which the return loss is 10 dB is considerably wide to be 400 MHz. When the return loss is 10 dB or more, transmission loss of an antenna is reduced so that performance of the antenna is improved. FIG. 20 confirms that the multilayer-type patch antenna according to one embodiment of the present invention improves performance.

Figure 21:
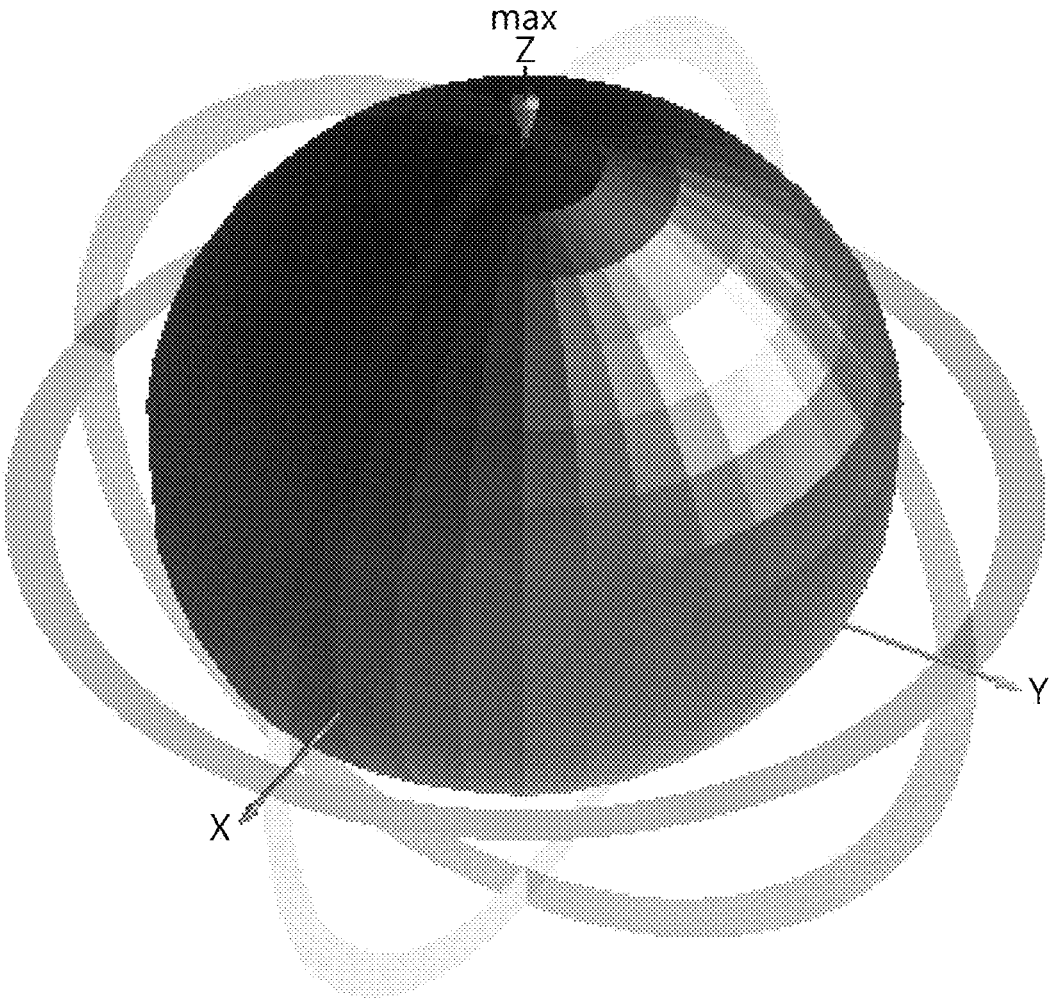
Figure 22:
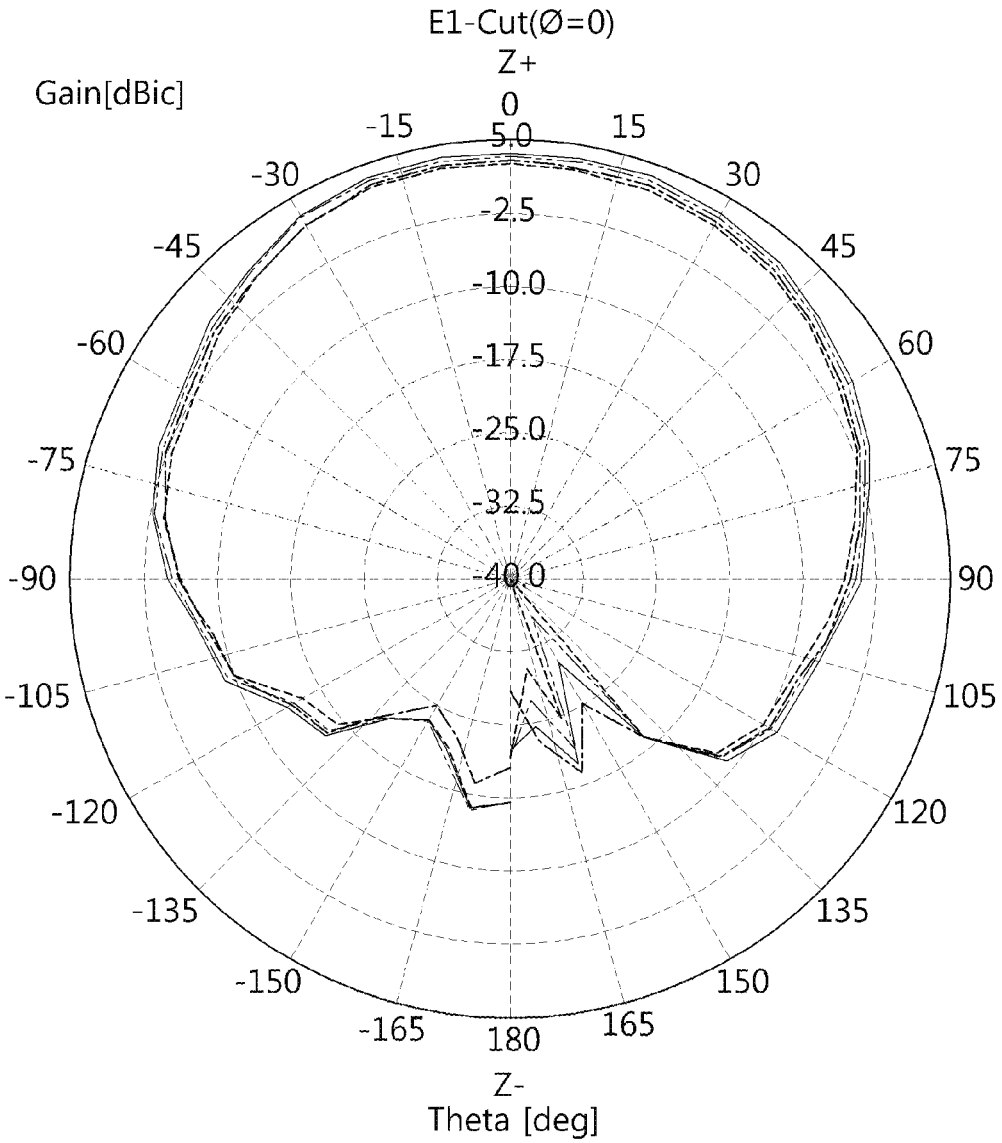

FIGS. 21 and 22 are diagrams describing a radiation pattern and gain of a multilayer-type patch antenna according to one embodiment of the present invention. FIG. 21 is a three-dimensional radiation pattern of a multilayer-type patch antenna, and FIG. 22 is a two-dimensional radiation pattern of a multilayer-type patch antenna at $\phi=0$.

FIG. 23 is a table which briefly summarizes GPS/GLONASS characteristics of a multilayer-type patch antenna according to one embodiment of the present invention, which can be understood from FIGS. 19 to 22.

In FIG. 23, Eff. represents radiation efficiency of an antenna, Avg. represents an average gain of an antenna, Peak represents a peak gain, Zenith represents a gain at the zenith of an antenna, and AR represents an axial ratio.

FIG. 23 shows that the zenith gain is about 3 dBic for the full band, 1575 to 1608 MHz, for GPS/GLONASS, and the axial ratio is about 2.53 dB or less.

The general purpose of a patch antenna is to transmit and receive satellite signals. Accordingly, the zenith gain (i.e. the gain near the zenith) and the axial ratio are critical factors to determine the characteristics of an antenna. According to the specifications of one unit of a standard patch antenna, the zenith gain is about 2 dBic or more and the axial ratio is about 3 dB or less.

Accordingly, the multilayer-type patch antennas according to the present embodiment can receive signals for both GPS and GLONASS while meeting the specifications of standard patch antennas.

FIGS. 24 to 30 are diagrams describing SDARS frequency characteristics of the multilayer-type patch antenna according to embodiments of the present invention.

Figure 24:
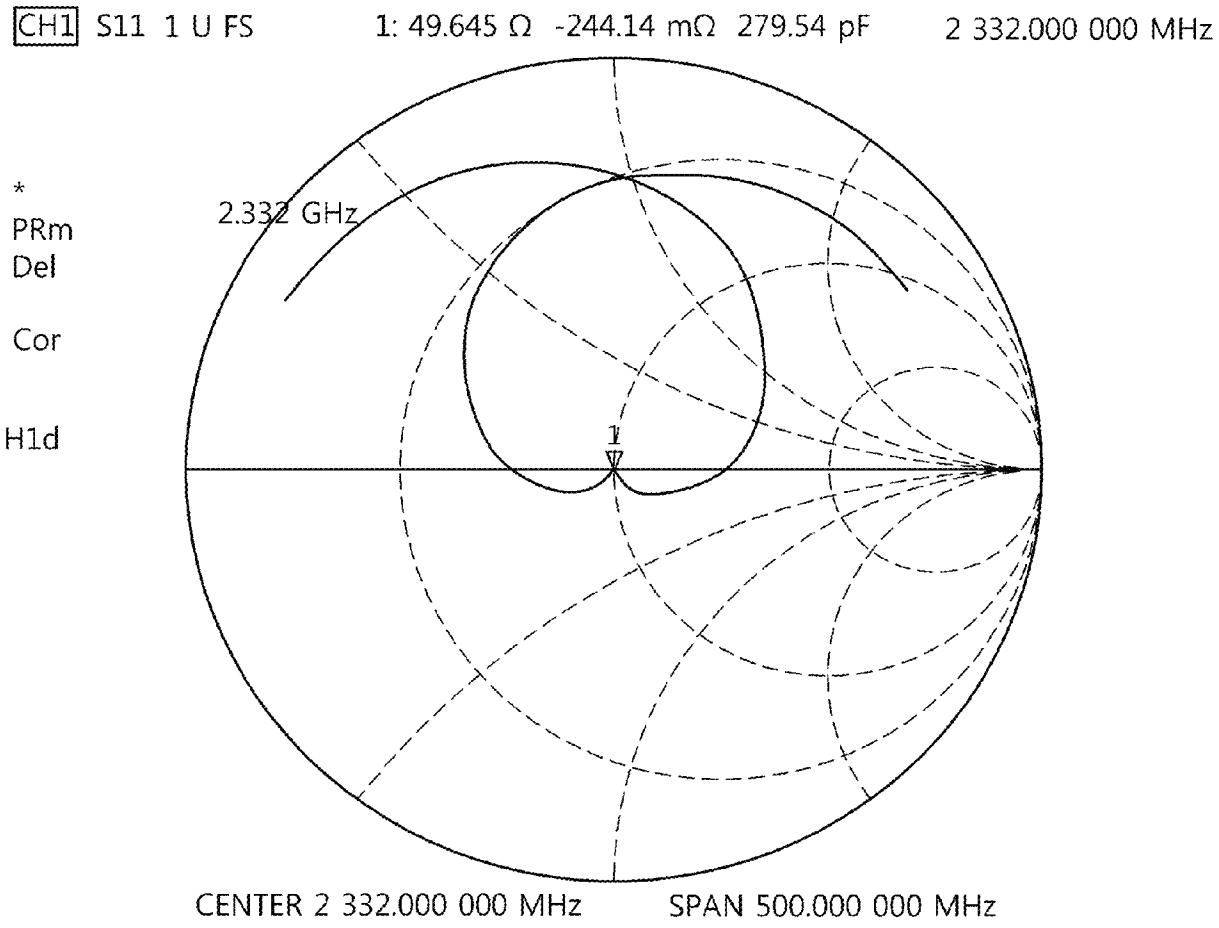

FIG. 24 is a Smith chart describing S11 characteristics of a multilayer-type patch antenna. The behavior in FIG. 24 occurs when characteristic impedance is 50 ohms for frequencies of from 2.320 to 2.345 GHz.

Figure 25:
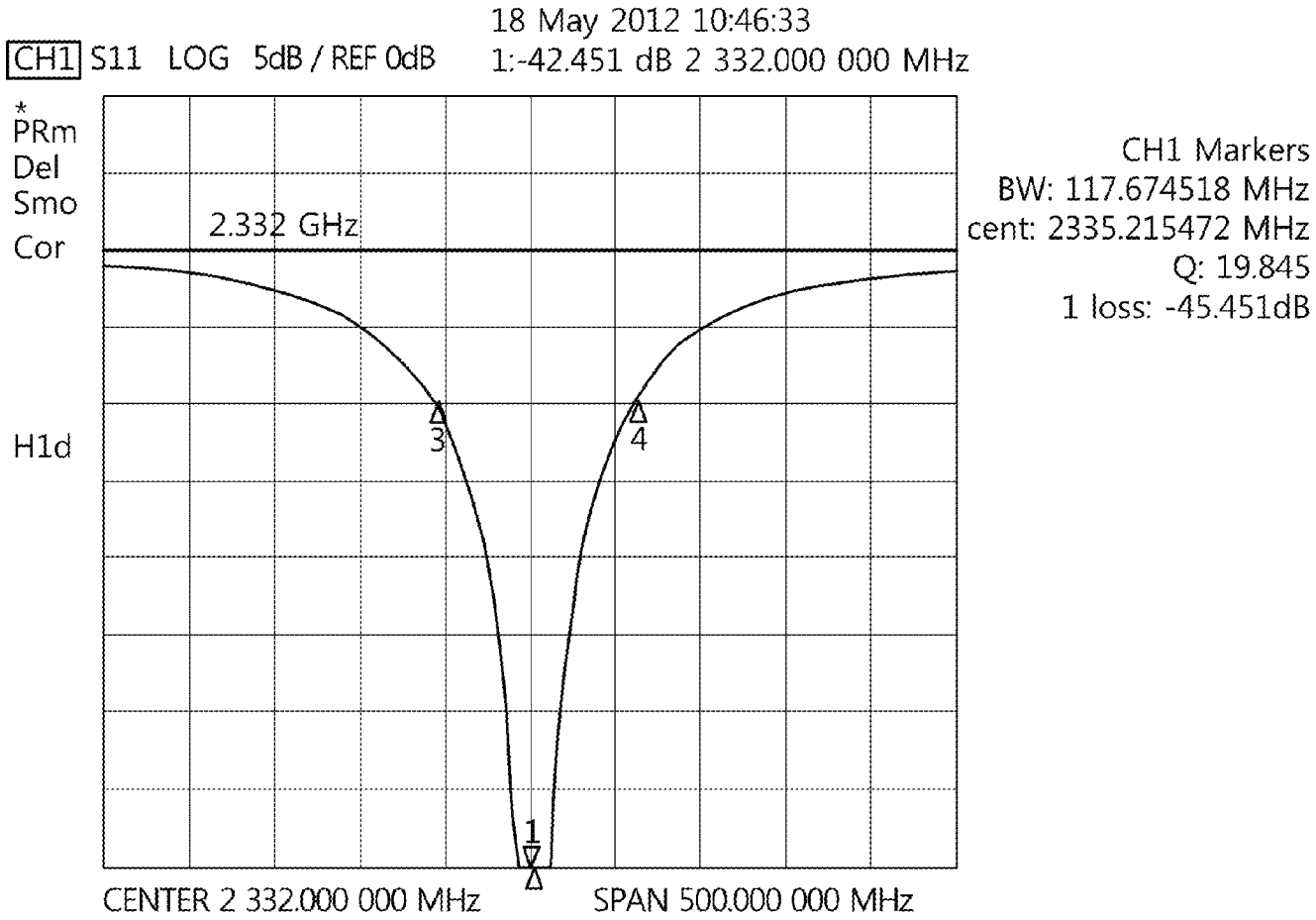

FIG. 25 is a log mag chart describing return loss and a bandwidth of a multilayer-type patch antenna. FIG. 20 shows that the return loss is about 42.451 dB for the frequency band of from 2.320 to 2.345 GHz. That is, for the full frequency band of from 2.320 to 2.345 GHz, the return loss meets the SDARS specifications specified by SIRIUS XM RADIO INC.

Figure 26:
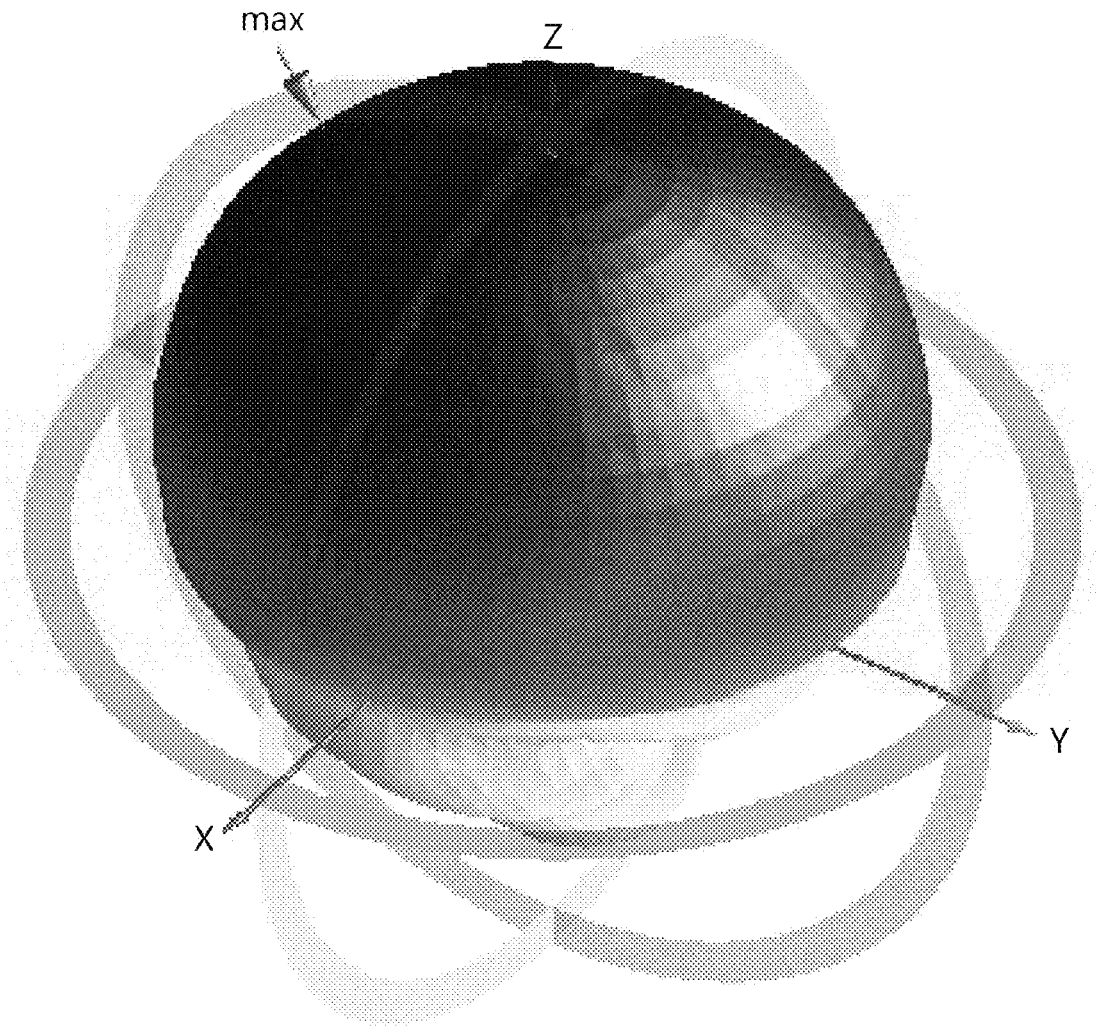
Figure 27:
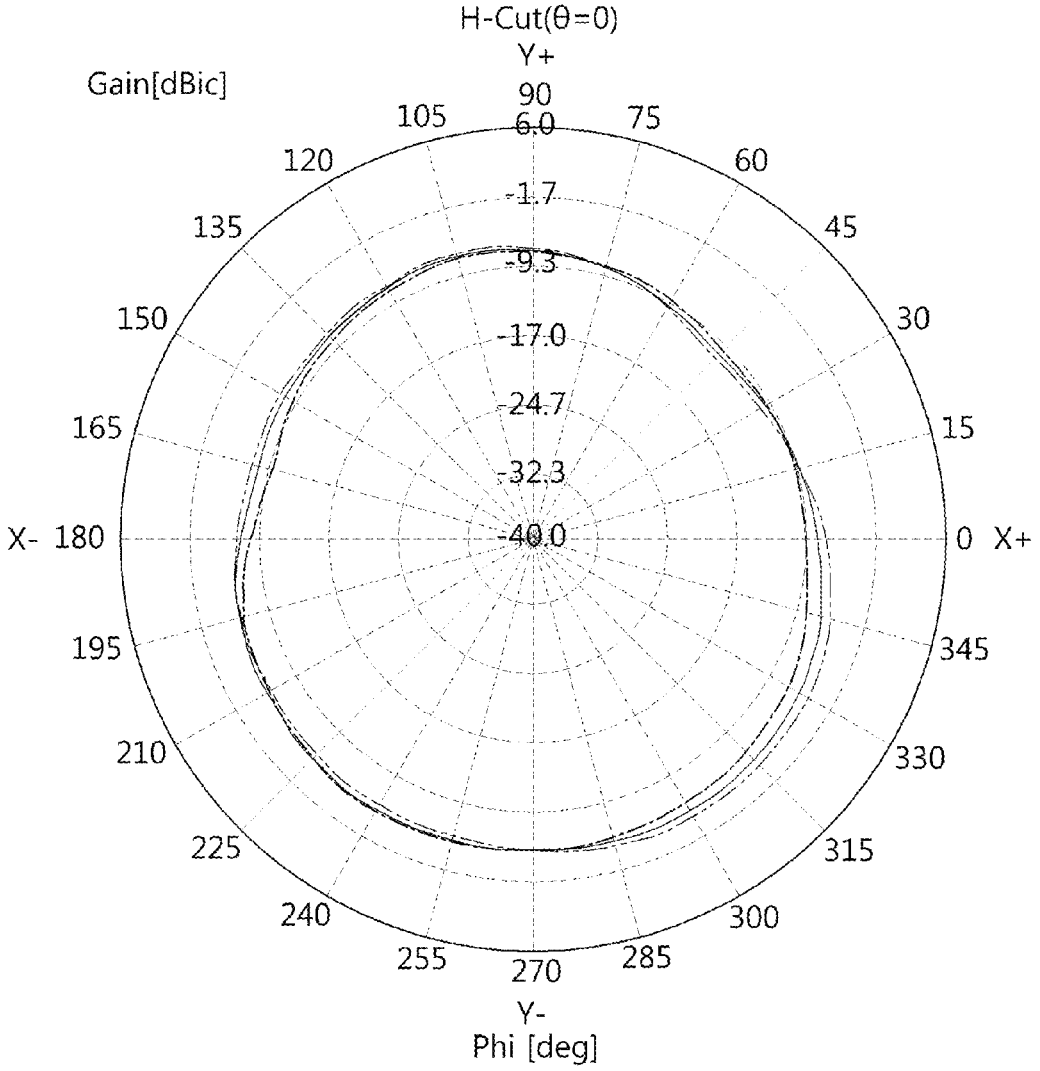
Figure 28:
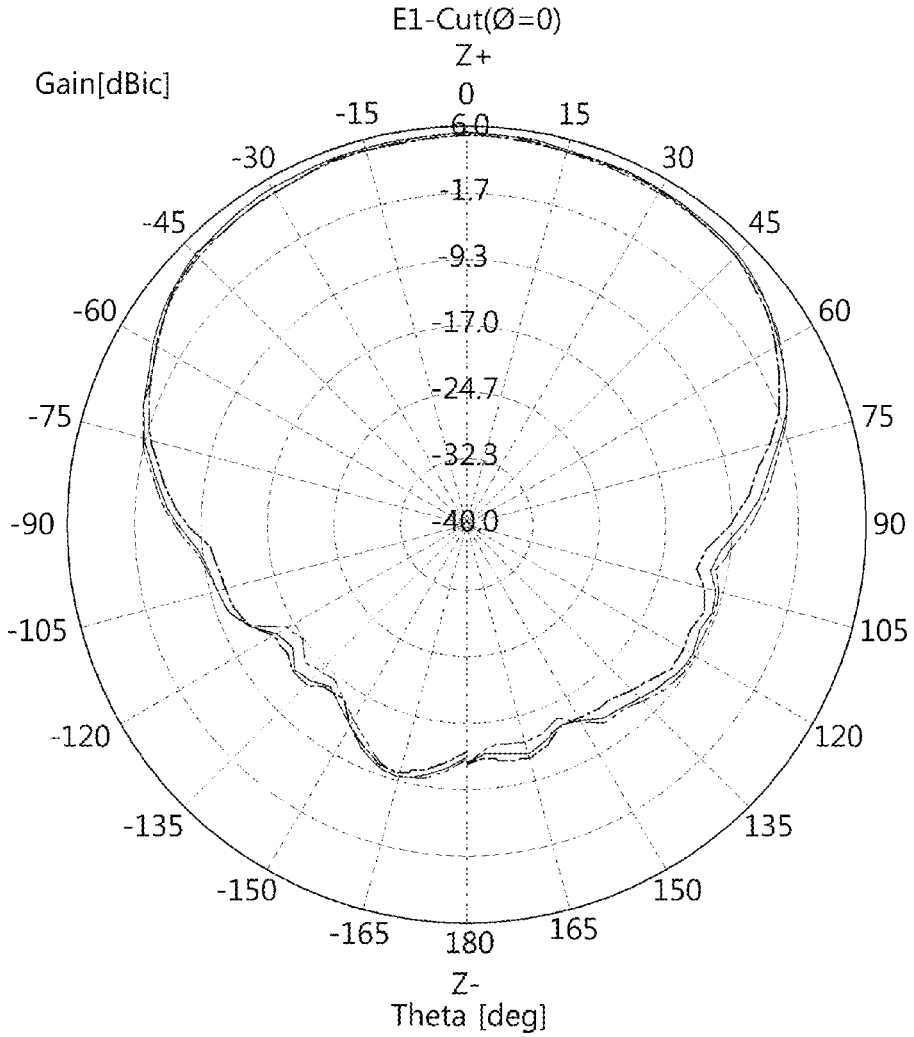
Figure 29:
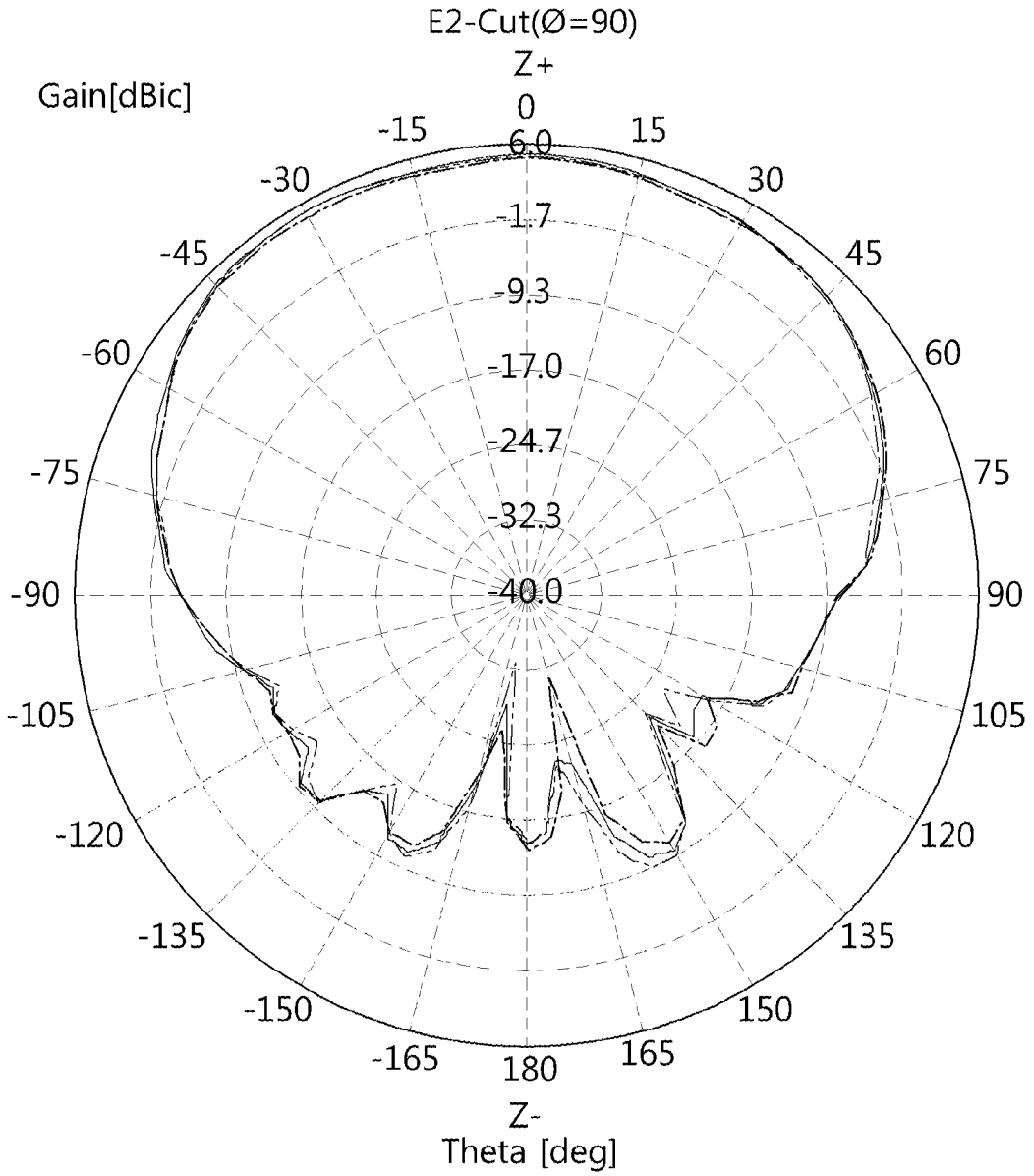

FIGS. 26 to 29 are diagrams describing a radiation pattern and gain of a multilayer-type patch antenna according to one embodiment of the present invention. FIG. 26 is a three-dimensional radiation pattern of a multilayer-type patch antenna, and FIG. 29 is a two-dimensional radiation pattern of a multilayer-type patch antenna at $\phi=0$.

FIG. 30 is a table that briefly summarizes SDARS characteristics of the multilayer-type patch antenna which are shown in FIGS. 24 to 29.

In FIG. 30, Eff. represents radiation efficiency of an antenna, Avg. represents average gain of an antenna, Peak represents a peak gain, Zenith represents a gain at the zenith of an antenna, and AR represents an axial ratio.

FIG. 30 shows that the zenith gain is about 4.83 dBic to 5.26 dBic for the full band, 2.320 to 2.345 GHz, for SDARS, and the axial ratio is about 1.6 to 2.3 dB.

Accordingly, it is understood that the multilayer-type patch antennas according to the embodiments of the present invention can meet the specifications for the SDARS of SIRIUS XM RADIO INC.

As described above, the multilayer-type patch antenna according to the present invention has a structure in which a patch antenna for receiving GPS and GLONASS signals and a patch antenna for receiving an ADARS signal are stacked. This structure makes it possible to receive all GPS, GLONASS, and SDARS signals while reducing the size and production cost of the antenna.

In addition, since the multilayer-type patch antenna according to the present invention has a structure in which a lower patch is formed on a side surface or a lower surface of a base layer, the multilayer-type patch antenna enables ultra-wide band reception which can receive all necessary signals, such as a GPS signal and a GLONASS signal.

In addition, since the multilayer-type patch antenna according to the present invention has a structure in which a lower patch is formed on a side surface or a lower surface of a base layer, the lower patch can be formed using a Surface-Mount Devices (SMD) technology. This leads to a reduction in the size and production cost of an antenna.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A multilayer-type patch antenna, comprising:

an upper patch antenna portion having a first through hole and a second through hole which are spaced apart from each other and are arranged such that an angle between the first through hole and the second through hole in reference to a center point of the upper patch antenna portion is a predetermined angle;

a lower patch antenna portion having a third through hole and a fourth through hole which are spaced from each other and are arranged such that an angle between the third through hole and the fourth through hole in reference to a center point of the lower patch antenna portion is the predetermined angle, and a fifth through hole which is spaced apart from the third through hole and the fourth through hole;

a first feeding pin, a portion of which passes through the first through hole and the third through hole and protrudes from a lower end of the lower patch antenna portion;

a second feeding pin, a portion of which passes through the second through hole and the fourth through hole and protrudes from the lower end of the lower patch antenna portion; and a third feeding pin, a portion of which passes through the fifth through hole and protrudes from the lower end of the lower patch antenna portion, wherein the upper patch antenna portion includes an accommodation portion that accommodates a head portion of the third feeding pin.

2. The multilayer-type patch antenna as set forth in claim 1, wherein an imaginary line that connects the first through hole and the center point of the upper patch antenna portion has a predetermined angle in reference to an imaginary line that connects the second through hole and the center point of the upper patch antenna portion.

3. The multilayer-type patch antenna as set forth in claim 1, wherein an imaginary line that connects the third through hole and the center point of the lower patch antenna portion has a predetermined angle in reference to an imaginary line that connects the fourth through hole and the center point of the lower patch antenna portion.

4. The multilayer-type patch antenna as set forth in claim 1, wherein the upper patch antenna portion comprises:

a first radiation patch having a first I-through hole and a second I-through hole which are arranged such that an angle between the first I-through hole and the second I-through hole in reference to a center point of the first radiation patch is the predetermined angle; and a first base layer which is a dielectric substrate or a magnetic substrate, has a first II-through hole and a second II-through hole in positions corresponding to the first I-through hole and the second I-through hole, respectively, and is stacked on a lower surface of the first radiation patch.

5. The multilayer-type patch antenna as set forth in claim 4, wherein an imaginary line that connects the first I-through hole and the center point of the first radiation patch has the predetermined angle in reference to an imaginary line that connects the second I-through hole and the center point of the first radiation patch.

6. The multilayer-type patch antenna as set forth in claim 4, further comprising:

a first lower patch having a first III-through in a position corresponding to the first I-through hole and the first II-through hole and a second III-through hole in a position corresponding to the second I-through hole and the second II-through hole, the first lower patch being stacked on a lower surface of the first base layer.

7. The multilayer-type patch antenna as set forth in claim 1, wherein the upper patch antenna portion comprises:

a first radiation patch;

a first feeding patch having a first I-through hole and being spaced from the first radiation patch;

a second feeding patch having a second I-through hole and being spaced from the first radiation patch; and a first base layer which is a dielectric substrate or a magnetic substrate, which has a first II-through hole and a second II-through hole in positions corresponding to the first I-through hole and the second I-through hole, respectively, and on an upper surface of which the first radiation patch and the second feeding patch are stacked.

8. The multilayer-type patch antenna as set forth in claim 7, wherein an imaginary line that connects the first I-through hole and the center point of the first radiation patch has the predetermined angle in reference to an imaginary line that connects the second I-through hole and the center point of the first radiation patch.

9. The multilayer-type patch antenna as set forth in claim 7, further comprising:

a first lower patch having a first III-through hole in a position corresponding to the first I-through hole and the first II-through hole and a second III-through hole in a position corresponding to the second I-through hole and the second II-through hole, the first lower patch being stacked on a lower surface of the first base layer.

10. The multilayer-type patch antenna as set forth in claim 1, wherein the lower patch antenna portion comprises:

a second radiation patch having a third I-through hole and a fourth I-through hole in positions corresponding to the first through hole and the second through hole, respectively, and a fifth I-through hole spaced from the third I-through hole and the fourth I-through hole; and a second base layer which is a dielectric substrate or a magnetic substrate, which has a third II-through hole and a fourth II-through hole in positions corresponding to the third I-through hole and the fourth I-through hole, respectively and a fifth II-through hole in a position corresponding to the fifth I-through hole, and which is stacked on a lower surface of the second radiation patch.

11. The multilayer-type patch antenna as set forth in claim 10, wherein an imaginary line that connects the third I-through hole and a center point of the second radiation patch has the predetermined angle in reference to an imaginary line that connects the fourth I-through hole and the center point of the second radiation patch.

12. The multilayer-type patch antenna as set forth in claim 10, further comprising:

a second lower patch having a third III-through hole in a position corresponding to the third I-through hole and the third II-through hole, a fourth III-through hole in a position corresponding to the fourth I-through hole and the fourth II-through hole, and a fifth III-through hole in a position corresponding to the fifth I-through hole and the fifth II-through hole, the second lower patch being stacked on a lower surface of the second base layer.

13. A multilayer-type patch antenna, comprising:

an upper patch antenna portion having a lower surface within which a first feeding point and a second feeding point are formed such that an angle between the first feeding point and the second feeding point in reference to a center point of the lower surface of the upper patch antenna portion is a predetermined angle; and a lower patch antenna portion having a lower surface within which a third feeding point and a fourth feeding point are formed in positions corresponding to the first feeding point and the second feeding point, respectively and within which a fifth feeding point is formed to be spaced from the third feeding point and the fourth feeding point, the lower patch antenna portion being formed on the lower surface of the upper patch antenna portion, wherein the upper patch antenna portion includes:

a first feeding recess in which the first feeding point is inserted, and a second feeding recess in which the second feeding point is inserted, the lower patch antenna portion includes:

a third feeding recess in which the third feeding point is inserted, a fourth feeding recess in which the fourth feeding point is inserted, and a fifth feeding recess in which the fifth feeding point is inserted, and the third feeding point and the fourth feeding point supply power to the first feeding point and the second feeding point through coupling feeding.

14. The multilayer-type patch antenna as set forth in claim 13, wherein an imaginary line that connects the first feeding point and the center point of the upper patch antenna portion has the predetermined angle in reference to an imaginary line that connects the second feeding point and the center point of the upper patch antenna portion.

15. The multilayer-type patch antenna as set forth in claim 13, wherein an imaginary line that connects the third feeding point and a center point of the lower patch antenna portion has the predetermined angle in reference to an imaginary line that connects the fourth feeding point and the center point of the lower patch antenna portion.

16. The multilayer-type patch antenna as set forth in claim 13, wherein the upper patch antenna portion comprises:

a first radiation patch;

a first base layer which is a dielectric substrate or a magnetic substrate and is stacked on a lower surface of the first radiation patch; and a first lower patch having the first feeding point and the second feeding point in a lower surface thereof and being stacked on a lower surface of the first base layer, the first feeding point and the second feeding point being arranged such that an angle between the first feeding point and the second feeding point in reference to a center point of the first lower patch is a predetermined angle.

17. The multilayer-type patch antenna as set forth in claim 16, wherein an imaginary line that connects the first feeding point and the center point of the first lower patch has the predetermined angle in reference to an imaginary line that connects the second feeding point and the center point of the first lower patch.

18. The multilayer-type patch antenna as set forth in claim 16, wherein the upper patch antenna portion comprises:

a first feeding patch and a second feeding patch which are disposed on an upper surface of the first base layer and spaced from the first radiation patch, wherein an imaginary line that connects a center point of the first feeding patch and a center point of the first radiation patch has the predetermined angle in reference to an imaginary line that connects a center point of the second feeding patch and a center point of the first radiation patch, and wherein the first feeding point and the second feeding point overlap the center point of the first feeding patch and the center point of the second feeding patch, respectively.

19. The multilayer-type patch antenna as set forth in claim 13, wherein the lower patch antenna portion comprises:

a second radiation patch;

a second base layer which is a dielectric substrate or a magnetic substrate and is stacked on a lower surface of the second radiation patch; and a second lower patch having a lower surface within which the third feeding point and the fourth feeding point are formed in positions corresponding to the first feeding point and the second feeding point, respectively and within which the fifth feeding point is spaced from the third feeding point and the fourth feeding point, the second lower patch being stacked on a lower surface of the second base layer, wherein an imaginary line that connects the third feeding point and a center point of the second lower patch has the predetermined angle in reference to an imaginary line that connects the fourth feeding point and the center point of the second lower patch.

* * * * *